US007419010B2

(12) United States Patent
Yoshida

(10) Patent No.: US 7,419,010 B2
(45) Date of Patent: Sep. 2, 2008

(54) SEAL BREAKING APPARATUS OF GAS CYLINDER

(76) Inventor: Hideo Yoshida, 2-9-2, Matsugaoka, Tokorozawa-shi, Saitama (JP)

( * ) Notice: Subject to any disclaimer, the term of this patent is extended or adjusted under 35 U.S.C. 154(b) by 0 days.

(21) Appl. No.: 10/592,334

(22) PCT Filed: Feb. 7, 2006

(86) PCT No.: PCT/JP2006/302013

§ 371 (c)(1),
(2), (4) Date: Sep. 11, 2006

(87) PCT Pub. No.: WO2006/098098

PCT Pub. Date: Sep. 21, 2006

(65) Prior Publication Data

US 2007/0295519 A1 Dec. 27, 2007

(30) Foreign Application Priority Data

Mar. 15, 2005 (JP) ..... 2005-073593
Dec. 13, 2005 (JP) ..... 2005-359665

(51) Int. Cl.
*A62C 13/00* (2006.01)
*A62C 13/66* (2006.01)
*A62C 35/58* (2006.01)
*B65D 31/00* (2006.01)

(52) U.S. Cl. ..... 169/77; 169/71; 169/72; 169/85; 141/19; 222/5

(58) Field of Classification Search ..... 169/77, 169/71, 72, 85, 11, 30, 74, 75, 83, 88, 89; 222/5, 6; 141/19; 137/68.29, 68.3
See application file for complete search history.

(56) References Cited

U.S. PATENT DOCUMENTS

| | | | | | |
|---|---|---|---|---|---|
| 2,585,039 | A | * | 2/1952 | Rooke | 169/9 |
| 2,755,865 | A | | 7/1956 | Jacobs | |
| 2,864,534 | A | * | 12/1958 | Wrenn, Jr. | 222/5 |
| 3,012,694 | A | * | 12/1961 | Johnston | 222/5 |
| 3,121,240 | A | * | 2/1964 | MacKenzie | 441/94 |
| 3,618,669 | A | * | 11/1971 | Sachs | 169/76 |
| 3,667,549 | A | * | 6/1972 | Sachs et al. | 169/71 |
| 4,606,384 | A | * | 8/1986 | Neukomm | 141/329 |
| 5,114,041 | A | * | 5/1992 | DiForte | 222/6 |
| 5,676,190 | A | * | 10/1997 | Matsumoto et al. | 169/74 |

FOREIGN PATENT DOCUMENTS

| | | |
|---|---|---|
| JP | 48-16697 | 2/1973 |
| JP | 52-131608 | 10/1977 |
| JP | 54-497 | 1/1979 |
| JP | 60-63361 | 4/1985 |
| JP | 62-24199 | 2/1987 |

(Continued)

*Primary Examiner*—Darren W Gorman
(74) *Attorney, Agent, or Firm*—Jordan and Hamburg LLP

(57) ABSTRACT

The present invention provides a fire extinguisher. The fire extinguisher has two cylindrical bodies that can house a plurality of gas cylinders; a plurality of cylinder holders; a plurality of needle tubes that can break sealing plates sealing the gas cylinders; and a plurality of needle tube holders. Either the cylinder holders or the needle tube holders can move at the same time to break the sealing plates of the gas cylinders about the same time.

21 Claims, 30 Drawing Sheets

FOREIGN PATENT DOCUMENTS

| | | |
|---|---|---|
| JP | 5-88559 | 12/1993 |
| JP | 7-51398 | 2/1995 |
| JP | 7-12700 | 3/1995 |
| JP | 7-275388 | 10/1995 |
| JP | 7-313615 | 12/1995 |
| JP | 9-103512 | 4/1997 |
| JP | 3097169 | 7/2003 |
| JP | 2004-205096 | 7/2004 |
| WO | WO-03/042623 | 5/2003 |

* cited by examiner

SEAL BREAKING APPARATUS OF GAS CYLINDER

BACKGROUND OF THE INVENTION

The present invention relates to a seal breaking apparatus of a gas cylinder. This seal breaking apparatus is suitably used for a carbon dioxide fire extinguisher for household, office or vehicle using a cartridge type gas cylinder, and can compactly house a plurality of the gas cylinder in a cylindrical body, and improve to reduce in size and weight and an appearance. Further, the seal breaking apparatus can break a seal of the gas cylinders easily and safely in one time and use large quantity of gas quickly and safely. Furthermore, the seal breaking apparatus can prevent solidifying a dry ice and closing a passage after breaking the seal of the gas cylinders to thereby obtain a stable jetting state of a gas.

The carbon dioxide fire extinguisher has been widely used as a fire extinguisher of an electric facility and an oil fire since there are no contaminations after using it and it has stable quality for a long time of period.

Conventionally, as the carbon dioxide fire extinguisher, the following one has been used, that is, a fire extinguisher comprising a cylinder filled with high-pressure carbon dioxide, a jet head connected to the cylinder, and an approximately trumpet shaped horn for holding the carbon dioxide jetted from the jet head toward an origin of a fire.

The above-described fire extinguisher is used by jetting the carbon dioxide in the cylinder, solidifying it on an inner wall of the horn as a dry ice, scattering the dry ice with the carbon dioxide jetted as a gas, and jetting a mixture of the dry ice and the carbon dioxide toward the origin of a fire from an opening portion of the horn (for example, referring to Japanese Patent Application Laid Open No. 7 (1995)-51398).

However, as for the above-described carbon dioxide extinguisher, there are some problems. That is, a complicated operation is necessary when the fire is extinguished, that is, removing a safety plug, holding an operation handle while grasping a fixed lever, and directing the opening portion toward the origin of a fire while holding the horn. Such a complicated operation takes time and effort, and it cannot correspond to quickly extinguishing the fire. Further, it is hard to handle the fire extinguisher since it is large and heavy weight, and is difficult to keep an installation space since an occupying space is large. Furthermore, since a part of the carbon dioxide is used as a dry ice condition, a jet portion is closed by the solidification of the dry ice, so that a stable extinguishing action cannot be obtained.

Further, as the other pressure type fire extinguisher, the following one has been used, that is, a fire extinguisher comprising a container main body filled with a powder fire extinguishing chemical therein; a head portion mounted at an upper portion of the container main body; a pressure gas cylinder which is screwed into the head portion to be mounted in the container main body and carbon dioxide and nitrogen gas are filled therein; a handle; a perforating needle body for breaking the seal of a sealing plate of the pressure gas cylinder by interlocking with the handle operation; a fire extinguishing chemical discharge tube provided in the container main body; and a jet nozzle.

As for the above-described fire extinguisher, when the fire is extinguished, it is used by removing the safety plug, operating the handle to thereby lower the perforating needle, breaking the seal of the sealing plate of the pressure gas cylinder to thereby jet the carbon dioxide in the pressure gas cylinder into the container main body, successively pushing out the carbon dioxide by the nitrogen gas, guiding the powder fire extinguishing chemical to the fire extinguishing chemical discharge tube by the carbon dioxide, and jetting the chemical toward the origin of a fire from the jet nozzle (for example, referring to Japanese Patent Utility Model Laid Open No. 5 (1993)-88559).

However, as for the above-described powder fire extinguishing chemical fire extinguisher, there are some problems. That is, a complicated operation is necessary when the fire is extinguished, i.e., the operation comprising removing the safety plug, lowering the perforating needle body by operating the handle, seal-breaking the sealing plate of the pressure gas cylinder, and directing the jet nozzle toward the origin of a fire. This operation takes time and effort and cannot correspond to quickness of extinguishing the fire. Further, it is hard to handle the fire extinguisher since it is large and has heavy weight, and difficult to keep the installation space since the occupying space is large. Furthermore, since the pressure gas cylinder has a small capacity, the powder fire extinguishing chemical is jetted with the small capacity for a short time, so that there is a problem that the fully extinguishing action cannot be obtained.

In order to solve the above-described problems, the following apparatus for breaking a seal of a cylinder has been known (for example, referring to Japanese Patent Utility Model Laid Open No. 7 (1995)-12700, 62 (1987)-24199), that is, an apparatus comprising a plurality of a small cylinder screwed and mounted at a base; a cutter main body slidably provided at the base; a plurality of a cutter opposedly provided on one side of the cutter main body toward the sealing plate of the cylinder; a hollow case provided on another side of the cutter main body; and a piston comprising an electric ignition type squib is slidably housed in the hollow case. When breaking the seal of the cylinder, the squib is exploded ad moves the piston, the cutter is pierced to the sealing plate to break the seal, and then the gas in the small cylinders is taken out t to the outside.

However, the above-described seal breaking apparatus needs much power in order to break the seal of the sealing plates of the cylinders. Further, the mechanism is large-scale, precise and a high cost, since the apparatus uses the electric ignition type squib as a seal breaking means, and uses a means for exploding the gas sealed in the squib with an electric ignition system to thereby breaking the seal. Further, it is hard to obtain easiness, quickness and safeness of the operation. Furthermore, since a plurality of the cylinder is arranged in parallel, the apparatus is increased in size and it is hard to handle. Thus, it is hard to use the above-described seal breaking apparatus as the fire extinguisher or the small fire extinguisher for household.

BRIEF SUMMARY OF THE INVENTION

An objective of the present invention is to provide the seal breaking apparatus which is suitably used for the carbon dioxide fire extinguisher for household, office or vehicle using the cartridge type gas cylinder. This seal breaking apparatus can compactly house a plurality of the gas cylinder in the cylindrical body, reduce in size and weight and improve the appearance. Further, the seal breaking apparatus can break the seal of the gas cylinders easily and safely in one time and use large quantity of gas quickly and safely. Furthermore, the seal breaking apparatus can prevent solidifying the dry ice to close the passage after breaking the seal of the gas cylinders, to thereby obtain the stable gas jetting condition.

The seal breaking apparatus of the gas cylinder of the present invention comprises a gas cylinder which is filled with a gas and has an opening portion sealed with a sealing plate; a hollow cylindrical body capable of housing the gas cylinder;

a cylinder holder capable of holding the opening portion of the gas cylinder at a fixed position of the cylindrical body; a tip portion capable of breaking the seal of the sealed plate; a needle tube capable of guiding and discharging the filled gas to the outside; and a needle tube holder for holding the needle tube, wherein the cylinder holder and the needle tube holder are mutually separately arranged, and the needle tube holder and the sealing plate are provided to allow a relative approaching movement. In the seal breaking apparatus of the gas cylinder, a plurality of a cylinder holder and a plurality of a needle tube holder are provided in the cylindrical body, and a plurality of the gas cylinder is housed in the cylindrical body in the same axial direction. Furthermore, each cylinder holder or each needle tube holder is provided movably in one time, the seal of the sealing plate of each gas cylinder can be broken in approximately one time, and the seals of a plurality of the gas cylinder are broken in one time to thereby jet the filled gas in one time. Further, the jetting amount of the gas can be increased and an effect of gas jetting can be obtained quickly and accurately. Thus, for example, the extinguishing action by the fire extinguisher can be increased.

Further, in the present invention, the opening portions of a plurality of the gas cylinder housed in the cylindrical body are arranged in the same direction to thereby simplify the structure and easily assembling it.

Furthermore, in the present invention, the opening portions of a plurality of the gas cylinder housed in the cylindrical body are opposedly arranged each other to thereby rationally use the needle tube holder.

In the present invention, gas guiding tubes are connected in series between the gas cylinders, and are connected with a single nozzle. Accordingly, a tube arrangement of the gas guiding tube becomes easy, and a tube arrangement space becomes compact. So, the size of the cylindrical body or the seal breaking apparatus can be reduced and lightened.

In the present invention, the gas guiding tube is connected with each nozzle for every gas cylinder, so that the gas jetting for every gas cylinder can be obtained.

Further, in the present invention, a single or a plurality of a nozzle is provided at a top end portion of the cylindrical body, so that the jetting conditions of the gas from a plurality of the gas cylinder can be selected according to the application.

Further, in the present invention, a light is provided at the top end portion of the cylindrical body. The light can be lighted interlocking with the seal breaking operation. Accordingly, the gas can be jetted accurately and easily also at night or a power failure. Further, the light can be used as an emergency light. So, for example, the fire can be extinguished accurately and easily by the fire extinguisher, and the light can be used as a light for refuge.

In the present invention, a container housing the powder fire extinguishing chemical is provided at the top end portion of the cylindrical body, and the gas guiding tube is connected to the container at a its downstream side end portion, to thereby connect the container to the nozzle. Accordingly, a powder fire extinguisher using the gas of the gas cylinder can be obtained.

Further, in the present invention, at least one pair of a connecting plate which can be housed in the cylindrical body is provided in the cylindrical body. Further, the gas cylinder, the cylinder holder and the needle tube holder are arranged between the connecting plates, and can be held. Accordingly, the gas cylinder, the cylinder holder and the needle tube holder can be easily assembled through the connecting plates.

Furthermore, in the present invention, the tip portion of each needle tube is arranged on a center line of the sealing plate, so that the seal of the sealing plate can be broken easily and accurately by the needle tube.

As for the present invention, the filled gas is high pressure carbon dioxide, and it is suitable to the simple fire extinguisher. Further, the size is reduced and lightened, it can be easily used, and the appearance is increased, as compared with the conventional apparatus.

The seal breaking apparatus of the gas cylinder of the present invention comprises the gas cylinder filled with a gas and having the opening portion sealed with the sealing plate; the hollow cylindrical body capable of housing the gas cylinder; the cylinder holder capable of holding the opening portion of the gas cylinder at the fixed position of the cylindrical body; the tip portion capable of breaking the seal of the sealed plate; the needle tube capable of guiding and discharging the filled gas to the outside; and the needle tube holder for holding the needle tube, wherein the cylinder holder and the needle tube holder are mutually separately arranged, and the needle tube holder and the sealing plate are provided to allow a relative approaching movement. In the seal breaking apparatus further, a plurality of a cylindrical body is connected on the same axis, one side of the cylinder body is provided bendably or rotatively, and a single or a plurality of the cylinder holder and the needle tube holder is provided in the cylindrical body. Further, a single or a plurality of the gas cylinder is housed in the same axial direction, the cylinder holder and the needle tube holder is provided movably in one time, and the seal of the sealing plate of each gas cylinder can be broken in approximately one time. Furthermore, by bending or rotating one side of a plurality of the cylindrical body, the seals of a plurality of the gas cylinder are broken in one time to there by jet the filled gas in one time. Further, the jetting amount of the gas can be increased, and the gas can be jetted quickly and accurately by easy operation. For example, the extinguishing action by the fire extinguisher can be increased.

Further, in the present invention, a cam capable of interlocking with a bending and displacement of the one cylindrical body is provided at a connection portion of the cylindrical body, and one or both of a bottom portion of the gas cylinder and the needle tube holder is arranged facing to a rotation area of the cam. Further, the one or both of the cylinder portion and the needle tube holder is operated by cam operation, and then, the seal of each gas cylinder is broken in one time. Accordingly, the filled gas can be jetted in one time.

Furthermore, in the present invention, a plurality of the gas cylinder is housed in another cylindrical body to allow the approaching movement, and opening portions of these gas cylinders are opposedly arranged. Further, the needle tube holder having the needles tubes on the both sides is arranged between the opening portions. Accordingly, the needle tube holder can have the reasonable structure, and the structure can be simplified.

In the present invention, a movable body is provided at the one rotative cylindrical body, in which the movable body can be displaced in the axial direction after the cylindrical body is rotated at a predetermined angle. Further, a plurality of the cylinder holder and a plurality of the needle tube holder are provided in another cylindrical body. A plurality of the gas cylinder is housed in the same axial direction, and each needle tube holder is arranged to allow approaching movement on the cylinder holder side in one time by interlocking with the displacement of the movable body. Accordingly, the seal of each gas cylinder is broken in one time by rotating and operating the cylindrical body, to thereby jet the filled gas in one time.

Further, in the present invention, at least one pair of the connecting plate is movably provided in a plurality of the cylindrical body, and the movable body and a plurality of the needle tube holder are provided at the connecting plate. Further, operations of a plurality of the needle tube holder are interlocked with an operation of the movable body. Thereby, the seal breaking by each needle tube can be realized by the movable body.

Furthermore, in the present invention, at least one pair of the connecting plate is provided at a fixed position in a plurality of the cylindrical body. Further, a plurality of the cylinder holder is provided at the connecting plate, to there by hold the gas cylinder at the fixed position. Thereby, the seal breaking by needle tube can be realized by the movable body.

In the present invention, an operation piece is provided on a circumference surface of the one rotative cylindrical body, and a lock claw of the operation piece is disengageably provided at the movable body. Further, the movable body is movably energized in the axial direction, and the movable body is operated by a lock cancellation operation of the operation piece. Thereby, the safety on use of the seal breaking apparatus can be realized.

Further, in the present invention, a fixing member is provided at the fixed position in the end portion side of the one rotative cylindrical body. An engaging groove is formed on the fixed member, and the lock claw of the operation piece is disengageably provided at the engaging groove. Further, the one cylindrical body is whirl-stopped by the lock claw, to thereby increase the safety on use of the seal breaking apparatus. Further, the large holding space of the one cylindrical body can be kept, to thereby realize the easiness on use of the apparatus.

Furthermore, in the present invention, a joining ring is releasably provided at the connecting portion of the cylindrical body. Thereby, one side of the cylindrical body can be bent through peeling the joining ring, and the safety on use of the seal breaking apparatus can be kept.

As for the seal breaking apparatus of the present invention, a plurality of the cylinder holder and a plurality of the needle tube holder are provided in the cylindrical body, and a plurality of the gas cylinder is housed in the cylindrical body in the same axial direction. Furthermore, each cylinder holder or each needle tube holder is provided being movable in one time, and the seal of the sealing plate of each gas cylinder can be broken in approximately one time. Thereby, the seals of a plurality of the gas cylinder can be broken in one time and the filled gas can be jetted in one time. Further, the jetting amount of the gas can be increased, and the effect of quickly and accurately jetting the gas can be obtained. For example, the extinguishing action by the fire extinguisher can be increased.

Further, as for the present invention, the opening portions of a plurality of the gas cylinder housed in the cylindrical body are arranged in the same direction, to thereby simplify the structure and easily assembling it.

Furthermore, as for the present invention, the opening portions of a plurality of the gas cylinder housed in the cylindrical body are opposedly arranged each other, so that the needle tube holder can be rationally used.

As for the present invention, the gas guiding tubes are connected in series between the gas cylinders and connected with the single nozzle. Thereby, the tube arrangement of the gas guiding tube becomes easy, and the tube arrangement space becomes compact, to thereby reduce in size of the cylindrical body or the seal breaking apparatus.

As for the present invention, the gas guiding tube is connected with each nozzle for every gas cylinder, to thereby obtain the jetting of the gas for every gas cylinder.

Further, as for the present invention, a single nozzle or a plurality of nozzles are provided at the top end portion of the cylindrical body, to thereby select the jetting conditions of the gas from a plurality of the gas cylinder according to the application.

Further, as for the present invention, the light is provided at the top end portion of the cylindrical body, and can be lighted interlocking with the seal breaking operation. Accordingly, the gas can be jetted accurately and easily under night or a power failure. Further, the light can be used as the emergency light. So, for example, the fire can be extinguished accurately and easily by the fire extinguisher, and the light can be used as the light for refuge.

As for the present invention, the container housing the powder fire extinguishing chemical is provided at the top end portion of the cylindrical body, the downstream side end portion of the gas guiding tube is connected to the container, and the container is connected to the nozzle. Accordingly, there is an effect to obtain the powder fire extinguisher using the gas of the gas cylinder.

Further, as for the present invention, at least one pair of the connecting plate which can be housed in the cylindrical body is provided in the cylindrical body. Further, the gas cylinder, the cylinder holder and the needle tube holder are arranged between the connecting plates and possible to be held. Accordingly, the gas cylinder, the cylinder holder and the needle tube holder can be easily assembled through the connecting plates.

Furthermore, as for the present invention, the tip portion of each needle tube is arranged on the center line of the sealing plate, to thereby easily and accurately breaking the seal of the sealing plate by the needle tube.

As for the present invention, since the filled gas is the high pressure carbon dioxide, it is suitable to make the simple fire extinguisher. Further, it has a small size, light weight, easy use and good appearance as compared with the conventional apparatus.

As for the seal breaking apparatus of the present invention, a plurality of the cylindrical body is connected on the same axis, one side of the cylinder body is provided bendably or rotatively, and a single or a plurality of the cylinder holder and the needle tube holder is provided in the cylindrical body. Further, a single or a plurality of the gas cylinder is housed in the same axial direction, the cylinder holder and the needle tube holder is provided movably in one time, and the seal of the sealing plate of each gas cylinder can be broken in approximately one time. Therefore, by bending or rotating one side of a plurality of the cylindrical body, the seals of a plurality of the gas cylinder are broken in one time to thereby jet the filled gas in one time. Further, the jetting amount of the gas can be increased, and the effect of quickly and accurately jetting the gas can be obtained. For example, the extinguishing action by the fire extinguisher can be increased.

Further, as for the present invention, the cam capable of interlocking with the bending and displacement of the one cylindrical body is provided at the connection portion of the cylindrical body, and one or both of the bottom portion of the gas cylinder and the needle tube holder is arranged facing to the rotation area of the cam. Further, the one or both of the cylinder portion and the needle tube holder is operated by operating the cam, to thereby break the seal of each gas cylinder in one time. Accordingly, the filled gas can be jetted in one time.

Furthermore, as for the present invention, a plurality of the gas cylinder is housed in another cylindrical body to allow the approaching movement, and the opening portions of these gas cylinders are opposedly arranged. Further, the needle tube holder having the needles tubes on the both sides is arranged between the opening portions. Accordingly, the needle tube holder can have the rationally structure, and the structure can be simplified.

As for the present invention, the movable body is provided at the one rotative cylindrical body, and the movable body can be displaced in the axial direction after the cylindrical body is rotated at the predetermined angle. Further, a plurality of the cylinder holder and a plurality of the needle tube holder are provided in another cylindrical body. A plurality of the gas cylinder is housed in the same axial direction, and each needle tube holder is arranged interlocking with the displacement of the movable body to allow the approaching movement on the cylinder holder side in one time. Accordingly, the seal of each gas cylinder is broken in one time by rotating and moving operation of the cylindrical body, to thereby jet the filled gas in one time.

Further, as for the present invention, at least one pair of the connecting plate is movably provided in a plurality of the cylindrical body, and the movable body and a plurality of the needle tube holder are provided at the connecting plate. Further, operations of a plurality of the needle tube holders are interlocked with an operation of the movable body. Accordingly the seal breaking by each needle tube can be realized by the movable body.

Furthermore, as for the present invention, at least one pair of the connecting plate is provided at the fixed position in a plurality of the cylindrical body. Further, a plurality of the cylinder holder is provided at the connecting plate, to thereby hold the gas cylinder at the fixed position. Accordingly, the seal breaking by needle tube can be realized by the movable body.

As for the present invention, the operation piece is provided on the circumference surface of the one rotative cylindrical body, and the lock claw of the operation piece is disengageably provided at the movable body. Further, the movable body is movably energized in the axial direction, and the movable body is operated by the lock cancellation operation of the operation piece. Accordingly, the safety on use of the seal breaking apparatus can be realized.

Further, as for the present invention, the fixing member is provided at the fixed position in the end portion side of the one rotative cylindrical body. The engaging groove is formed at the fixed member, and the lock claw of the operation piece is disengageably provided at the engaging groove. Further, the one cylindrical body is whirl-stopped by the lock claw, to thereby keep the apparatus safe when stored. Further, the large holding space of the one cylindrical body can be kept, to thereby realize the easiness on use of the apparatus.

Furthermore, as for the present invention, the joining ring is releasably provided at the connecting portion of the cylindrical body. Accordingly, the one side of the cylindrical body can be bent through peeling the joining ring, to thereby keep the apparatus safe when stored.

BRIEF DESCRIPTION OF THE DRAWINGS

FIG. 4 is a cross-sectional view taken along the C-C line of FIG. 8, which is enlarged a little.

DETAILED DESCRIPTION OF THE INVENTION

Hereinafter, the present invention will be described with embodiments illustrated in drawings, which were applied to the carbon dioxide fire extinguisher for households, offices, stores and vehicles, that is, the fire extinguisher filled with carbon dioxide ($CO_2$). In FIGS. 1 to 18, 1 is a fire extinguisher holder mounted on a wall surface 2 in a room to have a predetermined height. The fire extinguisher holder has an elongated rectangular holder plate 3. In the fire extinguisher holder, one pair of locking pins 4, 5 having elasticity are projected on both sides of an upper portion and a middle higher portion of the plate 3, and a fire extinguisher 6 is vertically interposed between curved surfaces 4*a*, 5*a* inside the locking pins 4, 5.

Figure 9:
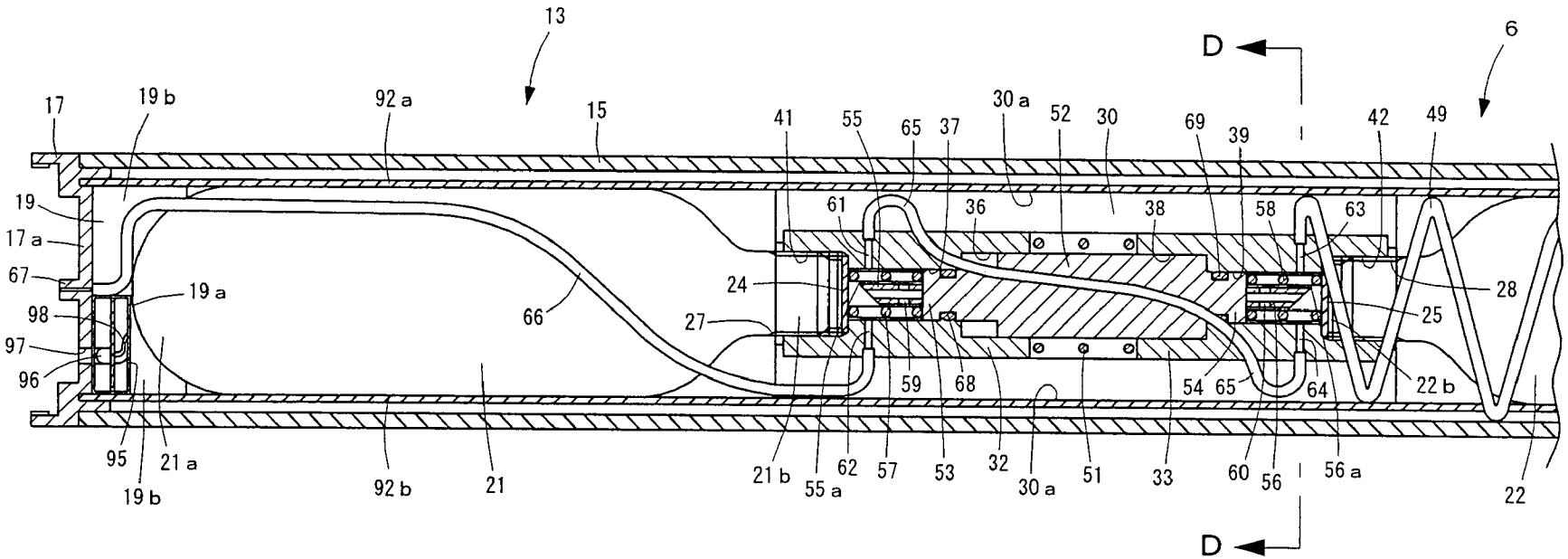
FIG. 9 is an enlarged a cross-sectional view illustrating main portions of FIG. 5, and an inside structure of a second cylindrical body side.
Figure 10:
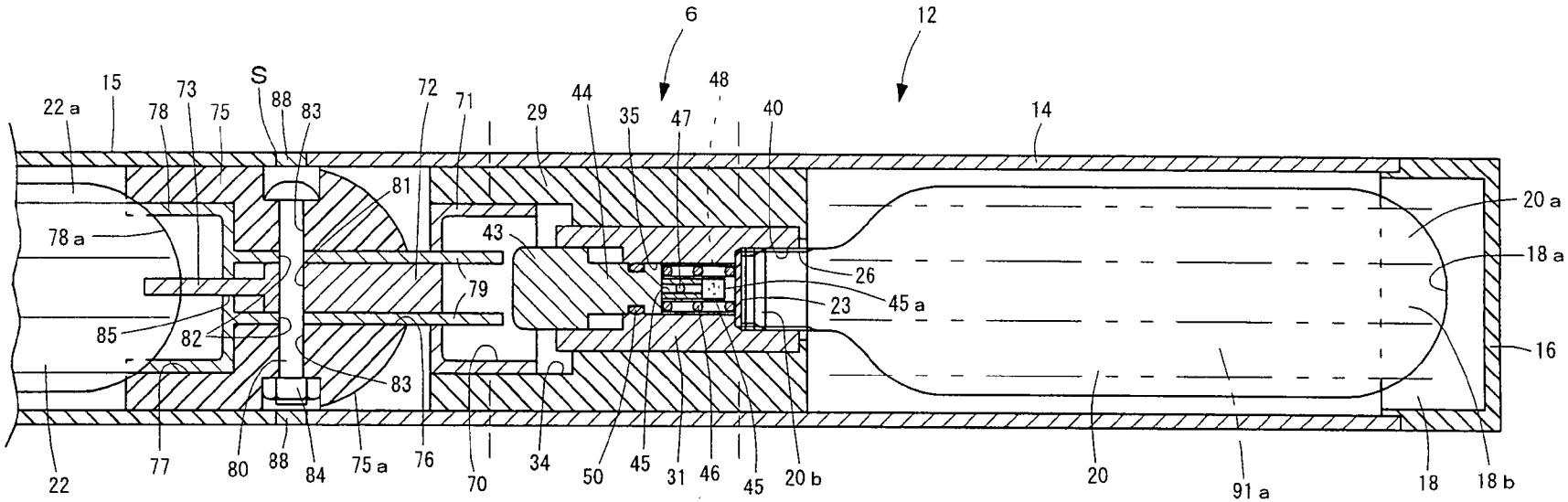
FIG. 10 is an enlarged cross-sectional view illustrating main portions of FIG. 6 and an inside structure of the first cylindrical body side.
Figure 11:
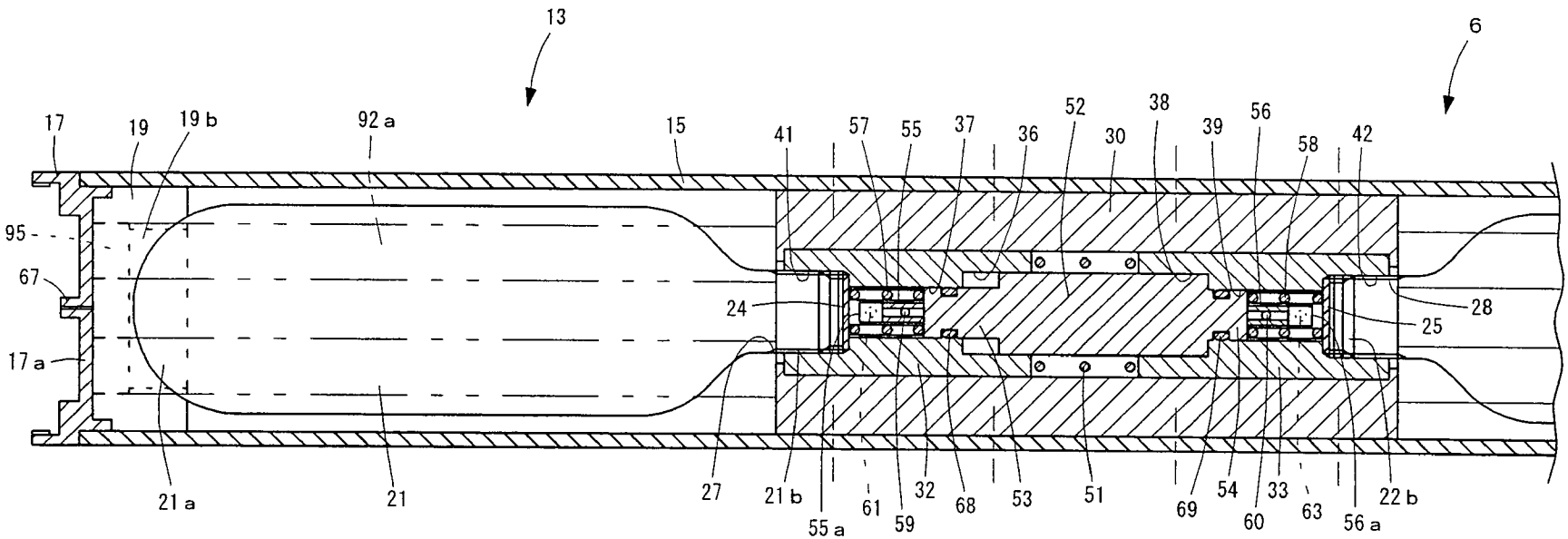
FIG. 11 is an enlarged cross-sectional view illustrating main portions of FIG. 6 and an inside structure of the second cylindrical body side.
Figure 12:
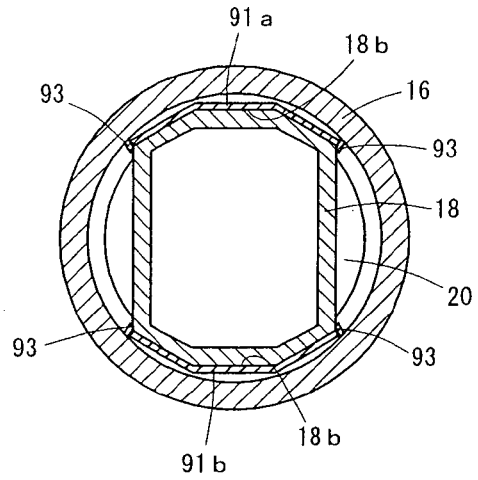
FIG. 12 is a cross-sectional view taken along the A-A line of FIG. 8, which is enlarged a little.
Figure 13:
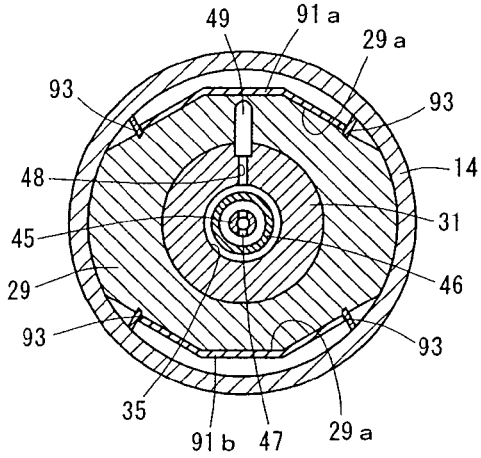
FIG. 13 is a cross-sectional view taken along the B-B line of FIG. 8, which is enlarged a little.
Figure 14:
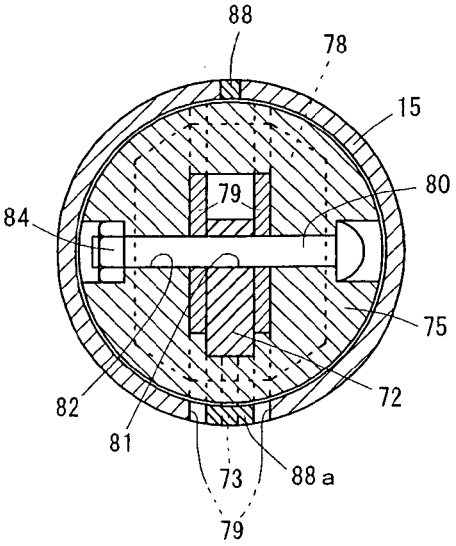
Figure 15:
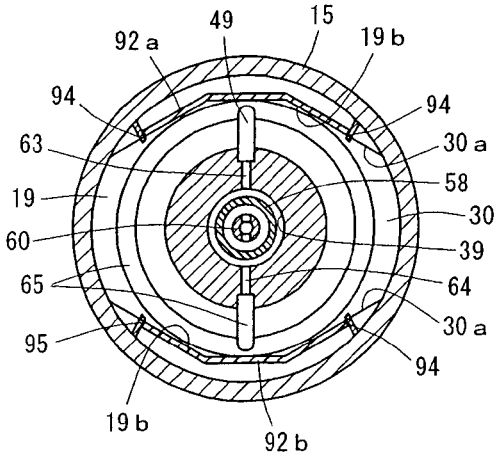
FIG. 15 is a cross-sectional view taken along the D-D line of FIG. 9, which is enlarged a little.

In the drawings, 7, 8 are display plates which are bendably provided on both sides of the upper portion of the holder plate 3. A plurality of explanation FIGS. 9, 10 showing a using method and a usage procedure of the fire extinguisher 6 is described on the surface of the display plates 7, 8. 11 is a bending piece provided at a lower end portion of the holder plate 3, and the bending piece 11 is provided capably of supporting the lower end portion of the fire extinguisher 6.

The fire extinguisher 6 is formed in an elongated cylindrical shape having an approximately same length as the fire extinguisher holder 1. The fire extinguisher 6 has large and small two cylindrical bodies 12, 13, which are first and second cylindrical bodies having same diameters and being graspable. Further, a connecting portion S between cylinders is bendably connected.

In the embodiment, the cylindrical bodies 12, 13 have the outer diameters of about 15 cm, the first cylindrical body 12 had the length of about 22 cm, the second cylindrical body 13 has the length of about 39 cm. The length ratio of the first and second cylindrical bodies is about 1:1.7. The smaller first cylindrical body 12 is arranged on the lower side as a grasping side, and the larger second cylindrical body 13 is arranged on the upper side as a jetting side. At this case, the length ratio and the arrangement can be reverse.

As for the first cylindrical bodies 12, 13, outer shells are formed with two outer cylinders 14, 15 being large and small respectively, which comprise tube bodies having same diameter and is made of aluminum or synthetic resin. Further, caps 16, 17, which are made of aluminum or the synthetic resin, are detachably provided with screws at outer end portions of the outer cylinders 14, 15.

Figure 7:
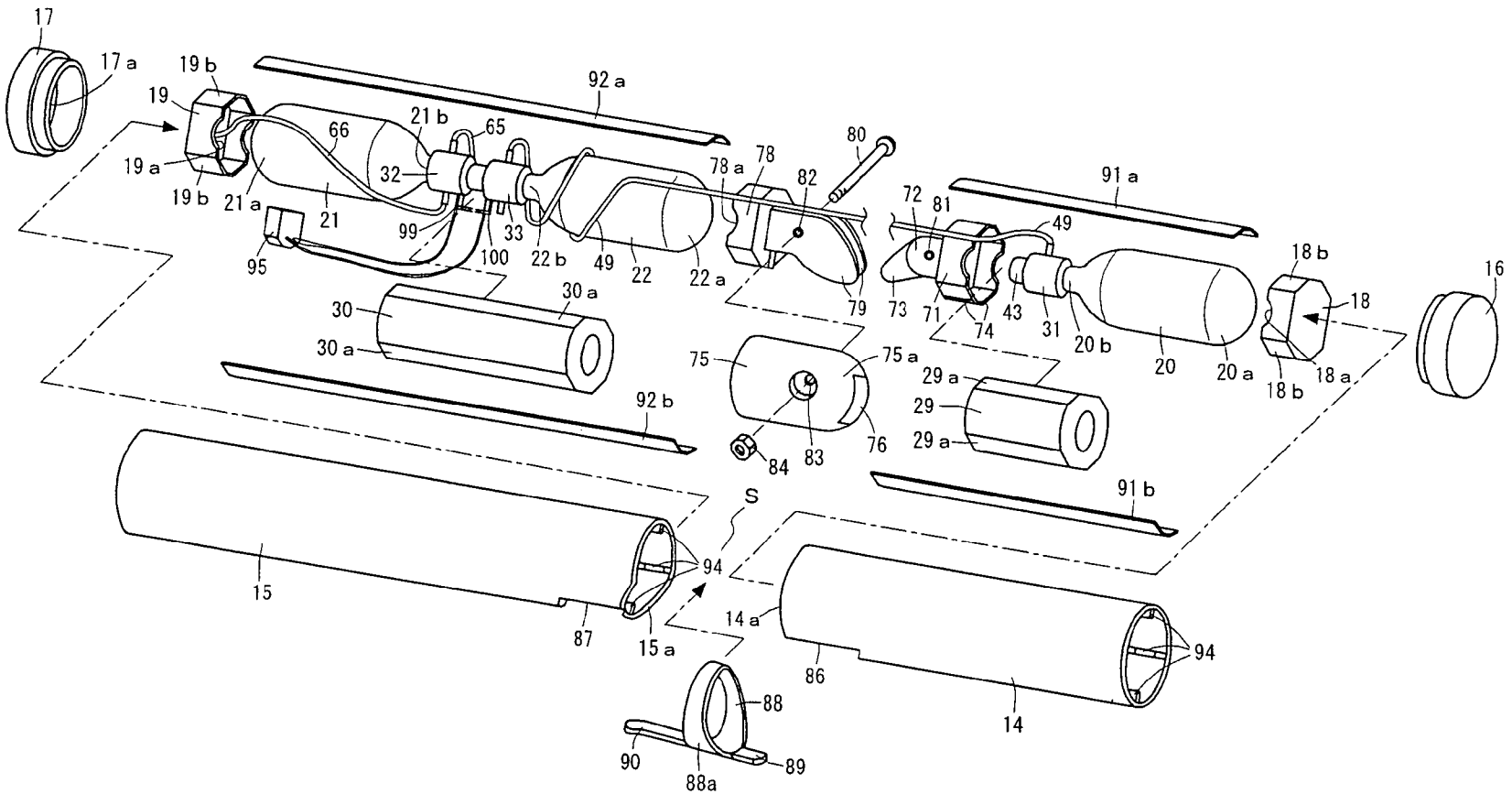
FIG. 7 is a perspective view illustrating a state in which main members of the carbon dioxide fire extinguisher according to the present invention are decomposed.

Cylinder supports 18, 19 molded with a resin in a dish shape are provided at the inside of the caps 16, 17. The cylinder supports 18, 19 are formed in a bottomed and hollow cylindrical shape as illustrated in FIG. 7, and locking portions 18*b*, 19*b* having an approximately roof shape are formed on the both sides on the cylinder supports 18, 19.

As for the cylinder supports 18, 19, recessed and curved portions 18*a*, 19*a* are formed at opening edge portions, and can be engaged with hemispherical bottom portions 20*a*, 21*a* of the gas cylinders 20, 21.

The single gas cylinder 20 made of metal is housed in the smaller outer cylinder 14, and a plurality of the gas cylinder, that is, the two gas cylinders 21, 22 made of metal are housed opposedly in this embodiment. The gas cylinders 20, 22 are housed in the same direction.

As the gas cylinders 20 to 22, commercial ones are used. The gas cylinders 20 to 22 are substantially formed in an approximately bottle shape. As for shape dimensions of these cylinders, the outer diameter is about 4 cm, the length is about 13 cm, and the tare is about 90 cc. Carbon dioxide of about 4 MPa is filled in these cylinders, and sealing plates 23 to 25 are provided at mouth portions 20*b* to 22*b* after filling the carbon dioxide. In the drawings, 26 to 28 are screw portions formed on the circumference surface on the mouth portions 20*b* to 22*b* side.

Joint blocks 29, 30, which are cylinder holders made of die-cast aluminum or the synthetic resin, are fixed with screws or the like at each middle portion of the outer cylinder 14, 15. The blocks 29, 30 have different lengths respectively, and have cross-sectional shapes formed in hollow cylindrical shapes, which are the same as those of the cylinder supports 18, 19. Further, the blocks 29, 30 have locking portions 29*a* 30*a* formed in roof shapes, which are the same as those of the locking portions 18*b*, 19*b*, on the circumference surfaces on the both sides.

A single guide cylinder 31 is fixed in the smaller joint block 29, and two guide cylinders 32, 33 are separately arranged in the larger joint block 30.

These guide cylinders 31 to 33 are substantial-identically formed by aluminum die-casting, and sliding holes 34, 35, 36, 37, 38 and 39, which have different diameters respectively, are formed in these guide cylinders.

Screw holes 40 to 42 are formed at end portions of one side of the sliding holes 35, 37 and 39, and the screw portions 26 to 28 of the gas cylinders 20 to 22 are screwed into the screw holes 40 to 42.

A push rod 43 and a shaft cylindrical portion 44, which is a needle tube holder made of metal, are slidably inserted into the sliding holes 34, 35. A needle tube 45 is projected at the shaft cylindrical portion 44, and a tip portion 45*a* of the needle tube 45 can pierce to the sealing plate 23.

A spring 46 is inserted into the needle tube 45, and the push rod 43 is energized to the outside of the guide cylinder 31 through the elasticity of the spring 46, so that the push rod 43 is usually projected toward the outside.

A through hole 47 is formed at the needle tube 45, and a guide hole 48 connecting to the sliding hole 35 is formed at the guide cylinder 31, and one end of a gas guide tube 49 made of a copper tube is connected with the hole 48. In the drawings, 50 is an O-ring mounted on the shaft cylindrical portion 44.

On the one hand, the guide cylinder 32 is fixed at an end portion of one side of the joint block 30, and the guide cylinder 33 is slidably inserted into the joint block 30. Further, a spring 51 is inserted between the guide cylinders 32 and 33, and the guide cylinder 33 is energized to the gas cylinder 22 side through the elasticity of the spring 51.

A slide rod 52 made of metal, which is the needle tube holder, is slidably inserted into the sliding holes 36, 38, and the shaft cylindrical portions 53, 54 on the both sides of the rod 52 are slidably inserted into the sliding holes 37, 39.

Tubes 55, 56 are projected at the shaft cylindrical portions 53, 54, and tip portions 55*a*, 56*a* of the needle tubes 55, 56 can pierce the sealing plates 24, 25.

Springs 57, 58 are inserted into the needle tubes 55, 56, and the slide rod 52 is energized to the inside of the guide cylinders 32, 33 through the elasticity of the springs 57, 58.

Through holes 59, 60 are formed at the needle tubes 55, 56, and two pairs of guide holes 61 to 64, which are connected with the sliding holes 37, 39, are formed at the guide cylinders 32, 33. Further, the guide holes 61 to 64 are connected with one ends of the gas guide tubes 49, 65 and 66 respectively.

That is, the guide hole 63 is connected with another end of the gas guide tube 49, to thereby guide the carbon dioxide jetted from the gas cylinder 20 to the guide hole 63. Further, both end portions of the gas guide tube 65 are connected between the guide holes 64 and 61, to thereby guide carbon dioxide jetted from the gas cylinders 20, 22 to the guide hole 61.

The guide hole 62 is connected with one end of the gas guide tube 66, to thereby guide carbon dioxide, which is jetted from the gas cylinders 20, 22 and 21, to a nozzle 67 connected with another end of the guide tube 66.

The nozzle 67 is projected at an end plate 17*a* of the cap 17, and for example, has a needle valve (it is not illustrated in the drawings) provided movably in the axial direction in a jet port thereof. Accordingly, an area of the jet port can be changed, and a jetting condition and a jetting distance of carbon dioxide can be changed. In the drawings, 68, 69 are O-rings mounted on the shaft cylindrical portions 53, 54.

On one hand, a recessed hole 70 is formed at an end portion of another side of the joint block 29. The hole 70 is formed to have a same cross-sectional shape as that of the cylinder support 18, and an end portion of the push rod 43 is arranged to be projectable and retractable in the hole 70.

A cam holder 71 made of die-cast zinc, which has an approximately same shape as the cylinder support 18, is fixed at the recessed hole 70. A thick cam plate 72 and a little thin first cam 73 are integrally projected at the outside of the holder 71.

The cam plate 72 is projected in the axial direction of the cam holder 71, the first cam is formed in an approximately leaf shape, and is bent diagonally downward from a top end portion of the plate 72.

The first cam 73 is projected and arranged in a coupling joint which will be described bellow. A basic portion of the cam 73 is simultaneous-movably connected with a second cam which will be described bellow, and the cam 73 can be rotated with the bending and displacement of the outer cylinder 14.

That is, as for the first cam 73, when the outer cylinder 14 is bent, the top end portion is engaged with the bottom portion 22*a* of the gas cylinder 22, to thereby push the cylinder 22 in the direction of the joint block 30.

In the drawings, 74 is one pair of a notch portion formed at the cam holder 71, and the notch portion 74 rotatively houses the second cam which will be described bellow.

A coupling joint 75 is fixed with the screw or the like at the end portion on the connecting portions S side of the outer cylinder 15. The joint 75 is formed in an approximately cylindrical shape with the die-cast aluminum. A top end portion of the joint 75 has a hemispherical portion 75*a* which is slidably inserted into the connecting portion S of the outer cylinder 14.

In the drawings, 76 is a cam through hole having wide width and opening at the hemispherical portion 75*a* and thereby, the cam plate 72 and a cam which will be described bellow can be inserted.

A recessed hole 77 is formed in the coupling joint 75, and the recessed hole 77 is formed to have the same cross-sectional shape as that of the cylinder support 18. A cylinder support 78 made of die-cast aluminum having an approximately same shape as the cylinder support 18 is fixed in the recessed hole 77.

A recessed and curved portion 78*a* is formed at an opening edge portion of the cylinder support 78, and arranged capable for engaging with the hemispherical bottom portion 22*a* of the gas cylinder 22.

One pair of a second cam 79 is integrally formed at the outside of the cylinder support 78. The cam 79 is larger than the first cam 73 and formed in an approximately leaf shape. The cam 79 is projected from the cylinder support 78 at the basis portion, and bent diagonally downward at the projected end portion.

The one pair of the second cam 79 is inserted into the cam through hole 76, and cam plate 72 is slidably inserted between the cams 79 and 79. These cams 79, 79 and the cam plate 72 are rotatively connected with the cam through hole 76 through a pin 80.

The one pair of the second cam 79 is simultaneous-movable with the bending operation of the outer cylinder 15 through the coupling joint 75 and the cylinder support 78 fixed at the coupling joint 75. A top end portion of the cam 79 is engaged with an end portion of the push joint 43 when the outer cylinder 15 is bent and thereby, the push rod 43 is movable in the direction of the joint block 29.

That is, pin holes 81 to 83 are formed at the cam plate 72, the base portion of the second cam 79 and the hemispherical portion 75*a*. The pin 80 is inserted into these pin holes. A nut 84 is screwed into a screw shaft end portion of the pin 80, to thereby rotatively connect the cam plate 72, the base portion of the second cam 79 and the hemispherical portion 75*a*.

In the drawings, 85 is a notch portion formed at the cylinder support 78 facing to a rotation locus of the cam 73, and rotatively houses the cam 73.

A semicircular surface of the connecting portion S of the outer cylinders 14, 15 is obliquely cut corresponding to a bending angled of the cylinders, and obliquely cut portions 14*a*, 15*a* are arranged to have a crossing angle θ. Notch portions 86, 87 are formed in the axial direction on the circumference surface on the obliquely cut portions 14*a*, 15*a* side, facing the rotation locus of the first and second cams 73, 79.

Figure 8:
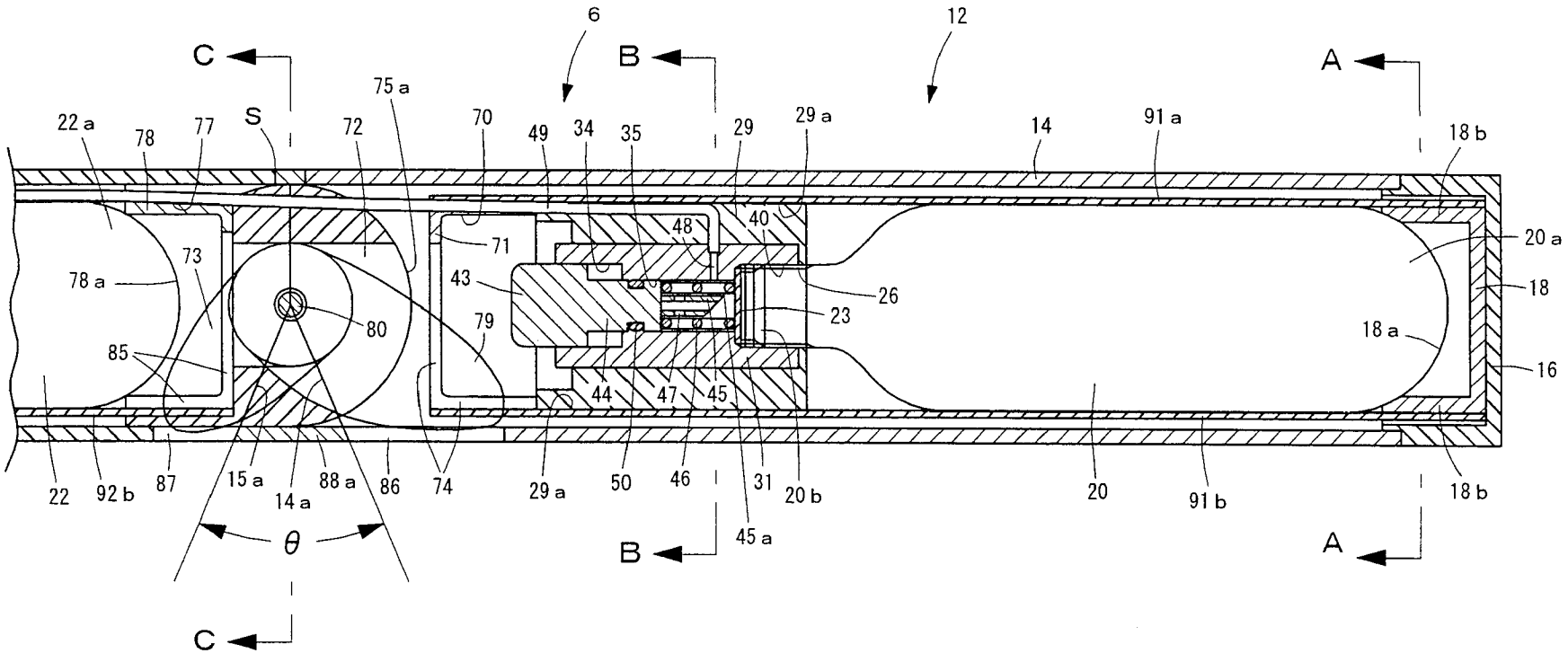
FIG. 8 is an enlarged cross-sectional view illustrating main portions of FIG. 5 and an inside structure of a first cylindrical body side.

The cam 73, 79 are housed having a fixed crossing angle in the outer cylinders 14, 15 before using the fire extinguisher 6, as illustrated in FIG. 8. The cam 73 is engageably arranged at a part being just under the bottom portion 22*a* of the gas cylinder 22. The cam 79 is engageably arranged at a part just under the top end portion of the push rod 43.

The connecting portion S is formed so as to separate a little corresponding end portions of the outer cylinders 14, 15, a joining ring 88 made of the synthetic resin is removably inserted into the connecting portion S.

A width of a semicircular portion of the joining ring 88 is increased gradually toward the obliquely cut portions 14*a*, 15*a*. A broad portion 88*a* is positioned at the largest portion between the obliquely cut portions 14*a* and 15*a*, and ordinarily prevents bending the outer cylinders 14, 15.

Further, when the fire extinguisher 6 is used, the joining ring 88 is removed from the connecting portion S, and the outer cylinders 14, 15 can be bent inside by the crossing angle θ centering on the broad portion 88*a*.

A tongue shaped joining piece 89 and a holding piece 90 are projected on the both sides of the broad portion 88*a*. The joining piece 89 is adhered on the circumference surface of the outer cylinder 14, and the holding piece 90 is releasably adhered on the circumference surface of the outer cylinder 14.

Further, when the fire extinguisher 60 is used, the holding piece 90 is released, and the joining ring 88 is cut at a narrow width portion to thereby separate the outer cylinders 14, 15. Further, the broad portion 88*a* is left at a circumference edge of the obliquely cut portion 14*a* through the joining piece 89, to thereby prevent a pinching accident of fingers at the connecting portion S.

In the drawings, 91*a*, 91*b*, 92*a* and 92*b* are connecting plates being large and small respectively, which are made of the synthetic resin or an aluminum plate, and opposedly arranged in the first cylinders 12, 13. Cross-sectional shapes of these plates are formed to have the same cross-sectional shapes of the locking portions 18*b*, 19*b* of the cylinder supports 18, 19.

The connecting plates 91*a*, 91*b* are bridged between the cylinder support 18 and the cam holder 71, and the connecting plates 92*a*, 92*b* are bridged between the cylinder support 19 and the cam holder 78. These connecting plates protect the gas cylinders 20 to 22 or the like which are arranged between these connecting plates, and are useful for easily assembling them.

93, 94 are locking projections projected on the inner surface of the outer cylinders 14, 15 in the tube axial direction, arranged engageably with end portions of the connecting plates 91*a*, 91*b*, 92*a* and 92*b*, and prevent moving these plates in the circumference direction.

In addition, in the drawings, 95 is a light box, which is fixed with the screw at the inside of the end plate 17*a* while engaging with the inner surface of the locking portion 19*b*, and is a transparent or semi-transparent approximately house shaped light made of the synthetic resin. A lamp 96 and a dry cell (it is not illustrated in the drawings) are housed in the light box 95, and the lamp 96 is arranged facing to an irradiation hole 97 formed at the end plate 17*a*.

That is, a lead wire 98 connected to the lamp 96 is drawn out from the light box 95, and another end of the lead wire 98 is connected to switch terminals 99, 100 projected at the guide cylinders 32, 33. A feeding circuit is closed by a contacting operation of the terminals 99 and 100, to thereby switch on the lamp 96.

As for the seal breaking apparatus of the gas cylinder having the above-described structure, the seals of the sealing plates 23 to 25 are broken by the bending operations of the first cylindrical bodies 12, 13. Therefore, precise and complicated parts are not necessary as compared with the conventional apparatus having the structure in which the electric ignition type squib is exploded, so that the apparatus can be produced with a low cost.

That is, in the seal breaking apparatus of the gas cylinder of the present invention, two first cylindrical bodies 12, 13 are bendably connected. Further, the first cylindrical bodies 12, 13 comprise the outer cylinder 14, 15, the caps 16, 17, the cylinder supports 18, 19, 78, the cam holder 71, the coupling joint 75, the cams 73, 79, the joint blocks 29, 30, the assembly of the joint blocks 29, 30, the gas cylinders 20 to 22, the gas guide tubes 49, 65, 66, and the connecting plates 91*a*, 91*b*, 92*a*, 92*b*.

Then, a case when producing the above-described main members in the structure will be described.

The outer cylinders 14, 15 are produced by the steps of drawing and forming an aluminum tube having an outer diameter of about 5 cm, in which a plurality of the locking projections 93, 94 is projected at the inner surface thereof; cutting the aluminum tube to have a predetermined length to produce two tubes being large and small respectively; forming the obliquely cut portions 14*a*, 15*a* at the semicircular portion of the end portion on the connecting portion S side; and forming the notch portions 86, 87 on the circumference surface of the end portion in the axial direction.

The caps 16, 17 are formed of aluminum to have the same diameter as those of the outer cylinders 14, 15, and the nozzle 67 and the through hole 97 are formed at the bottom plate 17*a* of the cap 17.

The cylinder supports 18, 19, 78 are formed in the approximately dish shape with the resin or the die-cast, and have one pairs of the roof shaped locking portions 18*b*, 19*b*, 78*b* formed at the outer circumference portion thereof.

The cam holder 71 is formed in the approximately same shape as that of the cylinder supports 18, 19, 78, and one pair of the roof shaped locking portion 71*b* is formed at the outer circumference portions thereof.

The coupling joint 75 is formed in the approximately cylindrical shape by die-casting. Further, the coupling joint 75 has the semicircular portion 75 formed at the top end portion thereof, and the cam through hole 76 is formed on the surface thereof.

The cams 73, 79 are formed in approximately a leaf shape by die-casting. The first cam 73 is projected and formed integrally with the cam holder 71. The second cams 79, 79 are projected and formed integrally with the cylinder support 78, opposing to the first cam 73 in a predetermined interval.

The joint blocks 29, 30 are formed in the approximately cylindrical shape to be large and small respectively by die-casting. One pair of the locking portions 29*a*, 30*a* is formed on the outer circumference of the joint blocks 29, 30, and the guide cylinders 31, 32 are fixed in these locking portions 29*a*, 30*a*.

Further, the guide cylinders 32, 33 are slidably mounted inside the joint block 30, and are usually energized to end portions on both sides of the joint block through the elasticity of the spring 51.

The sliding holes 35, 37, 39 are formed inside the guide cylinders 31 to 33. The screw holes 40 to 42 are formed at one end portions, and the push rod 43 having the needle tube 45 projected thereon is slidably fitted to the sliding holes 35 of the guide cylinder 31, to thereby energize a head portion of the push rod 43 to the outside of the guide cylinder 31 through the elasticity of the spring 46.

As the gas cylinders 20 to 22, the same commercial ones are used. As for the gas cylinders 20 to 22, after the carbon dioxide is filled in those, the sealing plates 23 to 25 are attached to the mouth portions 20*b* to 22*b*. The gas guide tubes 49, 65, 66 are produced by cutting the copper tube to have the predetermined length. The connecting plates 91*a*, 91*b*, 92*a*, 92*b* are produced by forming the synthetic resin plate to have the roof shaped cross-section and cutting it to have the predetermined length.

When each portion for the structure is assembled with the first cylinders 12, 13, for example, the cylinder support 78 is fixed by the screw at the coupling joint 75, the cylinder support 78 and one pair of the cam 79 are integrally inserted into the cam through hole 76, and the top end portions of the cams 79 are made to be projected from the hemispherical portion 75*a*.

Then, the cam holder 71 is fixed by the screw at the recessed hole 70 of the end portion of the one side of the joint block 29, and the cam holder 72 integrated with the cam plate 71 is inserted between the second cams 79 and 79. Further, the first cam 73 integrated with the cam plate 72 is inserted into the notch portion 85, and the top end portion of the cam 73 is made to be projected from the inside of the cylinder support 78.

Further, just before or after the above process, the one pair of the cam 79 is inserted into the one pair of the notch portion 74 formed at the cam holder 71, the top end portions of the cams 79, 79 are made to be projected from the inside of the cam holder 71, and the pin holes 81 to 83 are positioned respectively.

Then, the pin 80 is inserted into the one side of the coupling joint 75, and inserted into the pin holes 81 to 83. Further, the nut 84 is screwed into a screw portion at the top end of the pin 80 to be tightened and fastened, to thereby rotatively connect the one pair of the cam 79 and the cam plate 72 in a little frictional contact state.

Then, the screw portions 40 to 42 of the gas cylinders 20 to 22 filled with the carbon dioxide are screwed into the screw holes 40 to 42 of the guide cylinders 31 to 33 of each joint block 29, 30 to thereby be mounted. Then, the gas guide tubes 49, 65, 66 are connected with the guide holes 48, 61 to 64 of the guide cylinders 31 to 33.

That is, the gas guide tube 49 is connected with the guide holes 48, 63 while sandwiching the coupling joint 75 between those and the guide tubes 65 is connected with the guide holes 64, 61. Further, one end of the gas guide tune 49 is connected with the guide hole 62, and another end of the gas guide tune 49 is connected with a communication hole on the inner surface of the cap 17 connected with the nozzle 67.

Further, the cylinder supports 18, 19 are fixed by the screw at a predetermined position on the inner surface of the caps 16, 17, and the light box 95 is fixed by the screw at a predetermined position of the inside of the one cylinder support 19.

The light box 95 houses the lamp 96 and the dry cell (it is not illustrated in the drawings) inside thereof, and the lead wire drawn from the box 95 is connected with the switch terminals 99, 100.

Further, each member for the structure in the assembling state is housed on the connecting plates 91*b*, 92*b* on one side with an arrangement order illustrated in FIG. 7. The connecting plates 91*b*, 92*b* are inserted between the locking projections 93 and 93 at the lower side of outer cylinders 14, 15 with the corresponding structure members to support the members. Further, the connecting plates 91*a*, 92*a* on another side are inserted and supported between the locking projections 93 and 93 at the upper side of the outer cylinders 14, 15, while sandwiching the members for the structure.

When having the above-described structure, the connecting plates 91*a*, 92*a* are engaged with the locking projections 93, 93 which are the one pair on the upper and lower sides, to thereby prevent moving in the width direction. Further, the inner surfaces of the plates are closely fitted to the locking portions 29*a*, 30*a*, to thereby stably hold the joint blocks 29, 30 and each member for the structure.

Then, each joint block 29, 30 is positioned at a mounting position of the outer cylinders 14, 15, and fixed by screwing the screws (those are not illustrated in the drawings) into the joint blocks 29, 30 from the outside of the outer cylinders 14, 15.

Further, the coupling joint 75 is fitted to the portion on the connection portion S side of the outer cylinder 15, and the locking portion 78*b* of the cylinder support 78 is inserted between the end portions of the connecting plates 92*a*, 92*b*. Then, a screw (it is not illustrated in the drawings), is screwed into the coupling joint 75 from the outside of the outer cylinder 15 to fix it.

Then, the cap 16 is fitted to the other end portion of the outer cylinder 14, and the locking portion 18*b* of the cylinder support 18 is inserted between the end portions of the connecting plates 91*a*, 91*b*. Accordingly, the one end portions of the connecting plates 91*a*, 91*b* are held to prevent moving. Further, screws (those are not illustrated in the drawings) are screwed from the outside of the outer cylinder 14 to be fixed.

Like the cap 16, the cap 17 is fitted to the other end portion of the outer cylinder 15, and the locking portion 19*b* of the cylinder support 19 is inserted between the end portions of the connecting plates 92*a*, 92*b*. Accordingly, the one end portions of the connecting plates 92*a*, 92*b* are held to prevent moving. Further, screws (these are not illustrated in the drawings) are screwed from the outside of the outer cylinder 15 to be fixed.

In this way, when assembling the above-described portions, each member for the structure is integrated into the outer cylinders 14, 15 through the one pairs of the connecting plates 91*a*, 91*b* and 92*a*, 92*b*, to thereby easily and quickly assemble each member for the structure. Further, each member for the structure are closely fitted on the inner surface of the connecting plates 91*a*, 91*b*, 92*a*, 92*b* to be housed. Thereby, these plates are stably and firmly fixed.

Further, since gas cylinders 20 to 22 are arranged in series in the first and second cylindrical bodies 12, 13, the size and weight of the fire extinguisher 6 or the cylindrical bodies 12, 13 can be reduced as compared with the apparatus in which the gas cylinders are arranged in parallel.

Furthermore, the gas guide tubes 49, 65, 66 of the gas cylinders 20 to 22 are connected with the nozzle 67 through the guide cylinders 31, 33, 32, to thereby provide a single gas passage. Accordingly, the tube arrangement can be simplified, and reducing the size and weight can be increased, as compared with the apparatus in which the guide tubes 49, 65, 66 are connected with the nozzle 67.

Then, the joining ring 88 is inserted into the connecting portion S of the outer cylinders 14, 15, and the broad portion 88*a* is arranged at the largest span portion of the obliquely cut portions 14*a*, 15*a*. Further, the joining piece 89 is adhered on the circumference surface of the outer cylinder 14, and the holding piece 90 is arranged on the circumference surface of the outer cylinder 15.

At this time, when the top end of the holding piece 90 is bended outwardly a little, a releasing operation becomes easy. Further, when the base portion of the holding piece 90 is temporarily fixed (adhered) on the circumference surface of the outer cylinder 15, the miss-releasing can be prevented.

Figure 1:
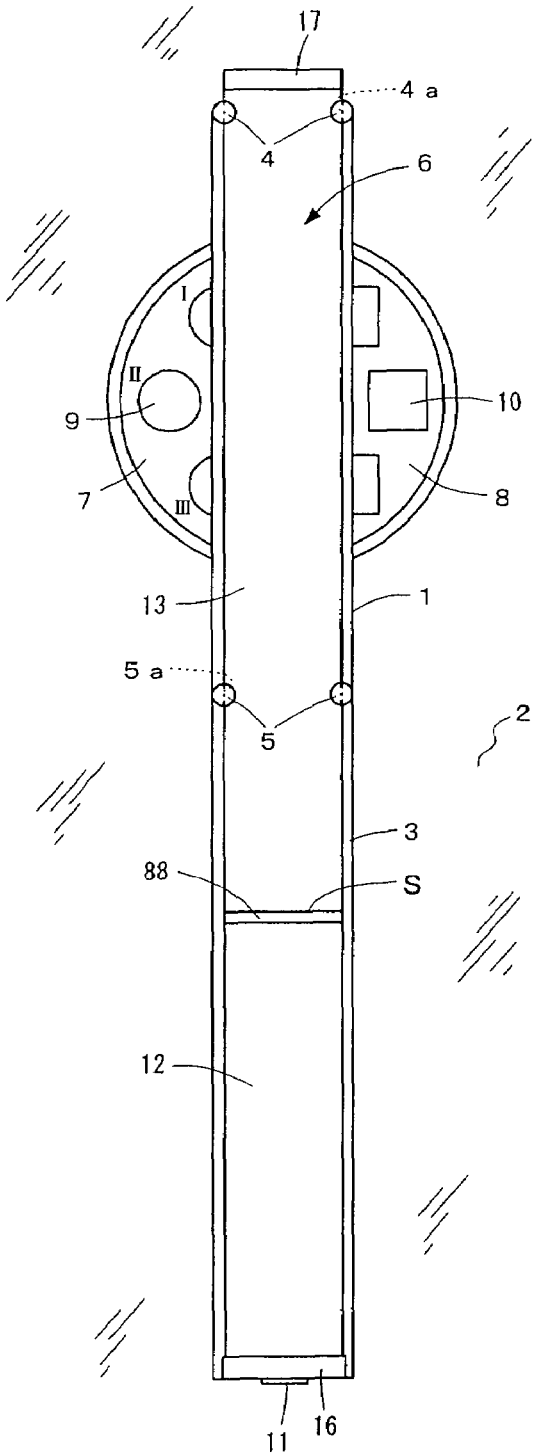
FIG. 1 is a front view illustrating an installing state of a carbon dioxide fire extinguisher according to the present invention.
Figure 2:
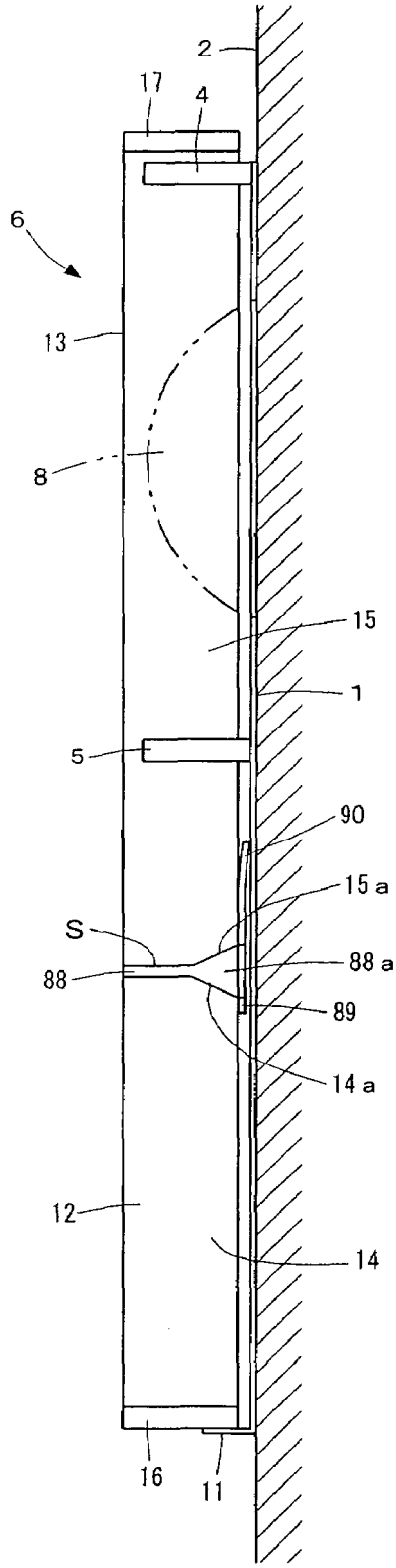
FIG. 2 is a right side view of FIG. 1.

The fire extinguisher 6 assembled in this way has an elongated rod shape as illustrated in FIGS. 1 and 2, and has an excellent appearance. Further, the extinguisher 6 has the low weight, i.e., about 1.5 kg. Accordingly, as compared with the conventional extinguisher, the fire extinguisher 6 has the reduced size and weight, and can be easily handled, for example, it can be easily carried, operated, or the like.

The above-described fire extinguisher is packed and provided while holding by the fire extinguisher holder 1.

That is, the fire extinguisher 6 is put between the locking pins 4, 5 of the fire extinguisher holder 1, where the pins are the one pair on the upper and lower sides, and can be held by the elasticity of the pins 4, 5.

Figure 4:
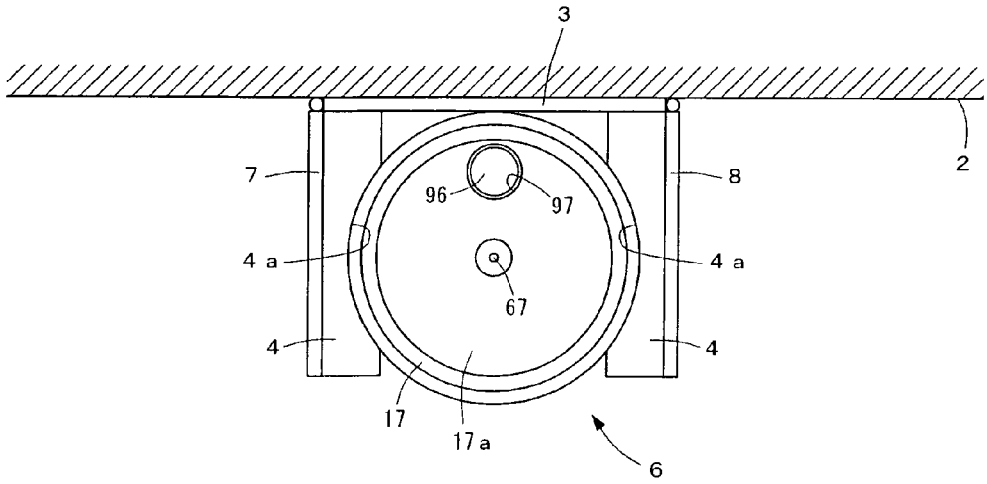
FIG. 4 is an enlarged plane view of FIG. 1 illustrating a state in which a display board is folded (packed).

When the fire extinguisher 6 is packed, it is packed while bending the display plates 7, 8 which are the one pair on the right and left sides, as illustrated in FIG. 4. Therefore, the fire extinguisher 6 is compactly packed, so that it can be easily handled.

Further, when the fire extinguisher 6 is provided, the holder plate 3 of the fire extinguisher holder 1 is mounted in the upper and lower directions at a desired position of the wall surface 2, and the fire extinguisher 6 is put in between the locking portions 4, 5 which are the one pair on the upper and loser sides. Accordingly, the fire extinguisher 6 is held by the elasticity of the pins 4, 5, and the lower end portion of the extinguisher 6 is held by the bending piece 11.

Figure 3:
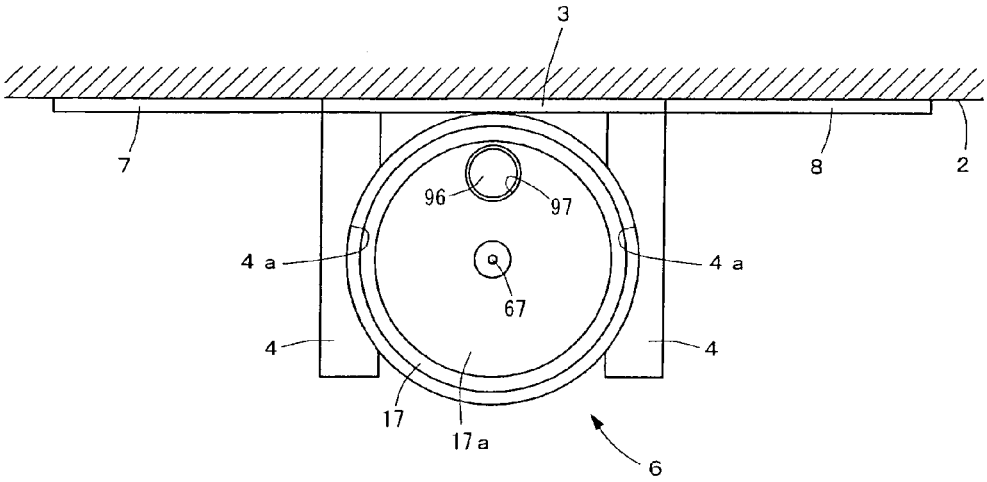
FIG. 3 is an enlarged plane view of FIG. 1.

Then, the display plates 7, 8 are developed in the lateral direction, and thereby, the described contents can be visually confirmed the described items in the plates 7, 8. Then, providing the fire extinguisher 6 can be completed. This state is illustrated in FIGS. 1 to 3.

In this case, when the broad portion 88*a* or the holding piece 90 of the joining ring 88 is arranged at a rear portion of the fire extinguisher 6, it can be prevented beforehand to scratch or release the holding piece 90, and it can be also prevented beforehand to accidentally bend the second cylindrical body 13.

At this time, when the larger second cylindrical body 13 having a large bending moment is arranged on the lower side, it can be prevented to bend the first cylindrical body 12, to thereby increase the safety of the fire extinguisher 6 when it is not used according to the above-described preventions.

In addition, it is also possible to arrange the holding piece 90 on the surface of the fire extinguisher 6 not like the above-described arrangement, to thereby treat the quick operation of the holding piece 90.

As for the fire extinguisher 6 provided in this way, as illustrated in FIGS. 1 to 3, the joining ring 88 is inserted between the first and second cylindrical bodies 12, 13, and the broad portion 88*a* of the joining ring 88 is positioned on the wall surface 2 side. Further, the joining piece 89 is adhered on the circumference surface of the outer cylinder 14, the holding piece 90 is closely fitted on the circumference surface of the outer cylinder 13, and the basis portion of the holding piece 90 is adhered. Accordingly, erection or linear states of the second cylindrical bodies 13, 12 can be held, to thereby prevent bending those. Therefore, the fire extinguisher 6 when it is not used may be stores safely.

Further, as for the gas cylinders 20 to 22, the bottom portions 20*a* to 22*a* are engaged with the recessed and curved portions 18*a*, 19*a*, 78*a* of the cylinder supports 18, 19, 78, and are closely fitted and held.

When the fire extinguisher 6 is not used, the erection or linear states of the second cylindrical bodies 13, 12 can be held, to thereby prevent bending those as described above.

Figure 5:
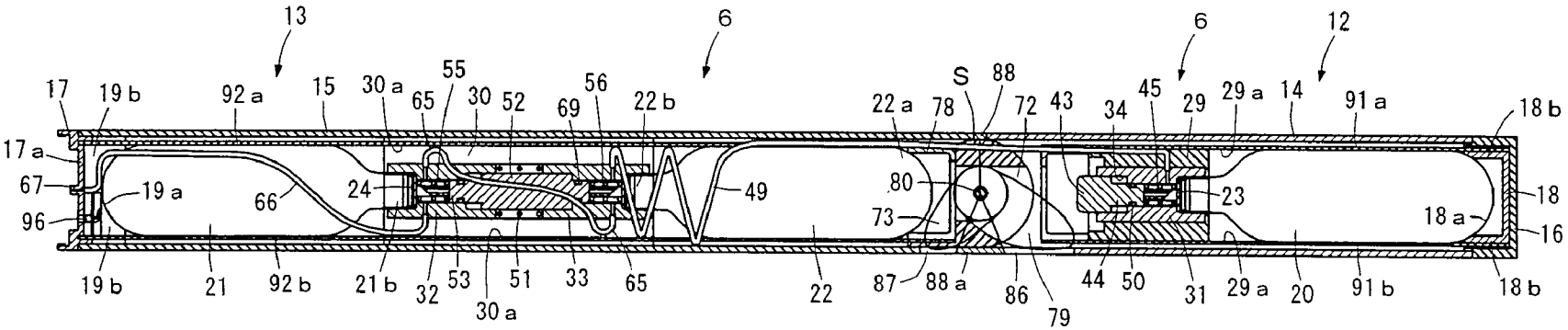
FIG. 5 is a longitudinal cross-sectional view of an inside structure of the carbon dioxide fire extinguisher according to the present invention.
Figure 6:
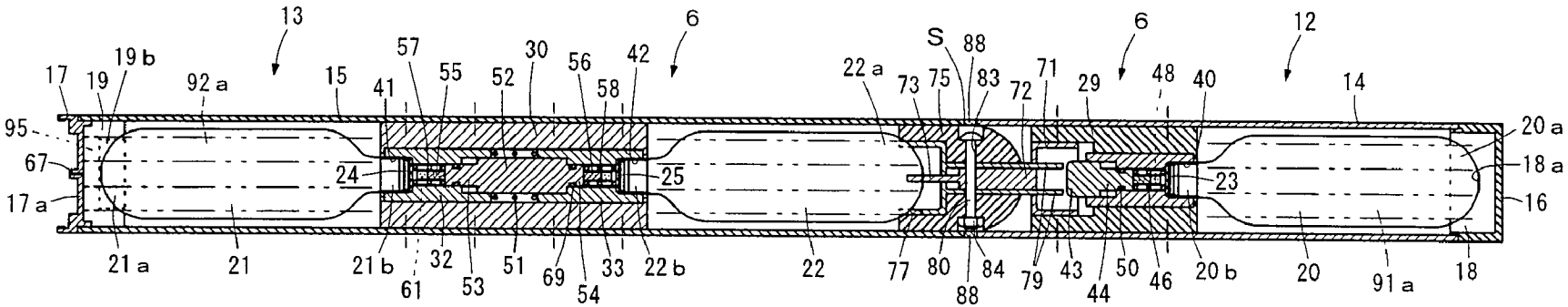
FIG. 6 is a transverse cross-sectional view in which the inside structure of the carbon dioxide fire extinguisher according to the present invention is rectangular cut with respect to the longitudinal direction of FIG. 5.

This state is illustrated in FIGS. 5 and 6. As for this state, the cam 73 is retreated to just under the bottom portion 22*a* of the gas cylinder 22, and the one pair of the cam 79 is retreated to just under the head portion of the push rod 43, to thereby cancel engaging with the bottom portions 22*a* or the push rod 43.

Therefore, the push rod 43 is energized on the cam holder 71 side by the elasticity of the spring 46, to thereby separate the tip portion 45*a* of the needle tube 45 from the sealing plate 23. Accordingly, the seal of the sealing plate 23 is not broken.

Further, the guide cylinder 33 is energized to the outside by the elasticity of the spring 51, to thereby separate the guide cylinders 32, 33. Further, since the slide rod 52 is positioned at the middle portion of the guide cylinders 32, 33 by the elasticity of the springs 57, 58 and the tip portions 55*a*, 56*a* of the needle tubes 55, 56 are separated from the sealing plates 24, 25, the seals of the sealing plates 24, 25 are not broken.

Therefore, in this case, the switch terminals 99, 100 are separated and the feeding circuit is opened, so that the lamp 96 is turned off.

Then, when fire is extinguished by using the fire extinguisher 6, the fire extinguisher 6 is held, drawn out to the front against the elasticity of the locking pins 4, 5, and removed from the fire extinguisher holder 1.

Then, the second cylindrical body 13 is held, the holding piece 90 of the joining ring 88 is held, and released in the axial direction of the fire extinguisher 6.

Then, the joining ring 88 is cut at a suitable position, and the ring 88 is released, to thereby form a space having a width corresponding to the ring 88 on the whole circumference of the connecting portion S in the first cylindrical bodies 12, 13. Then, the joining piece 89 is left on the circumference surface facing to the space, and the broad portion 88*a* and the joining ring 88 in which the seal is broken are moored at the holding piece 89.

While keeping this state, the first cylindrical bodies 12, 13 are held by both hands, and the space portion after releasing the broad portion 88*a* is directed downwardly, and the top end portion of the second cylindrical body, which is on the jetting side, is directed toward the origin side of fire.

Then, the cylindrical bodies 12, 13 are bent inwardly centering on the pin 80 positioned at the connecting portion S, and these bodies are bent until engaged with the obliquely cut portions 14*a*, 15*a*. Then, this state is kept.

Figure 16:
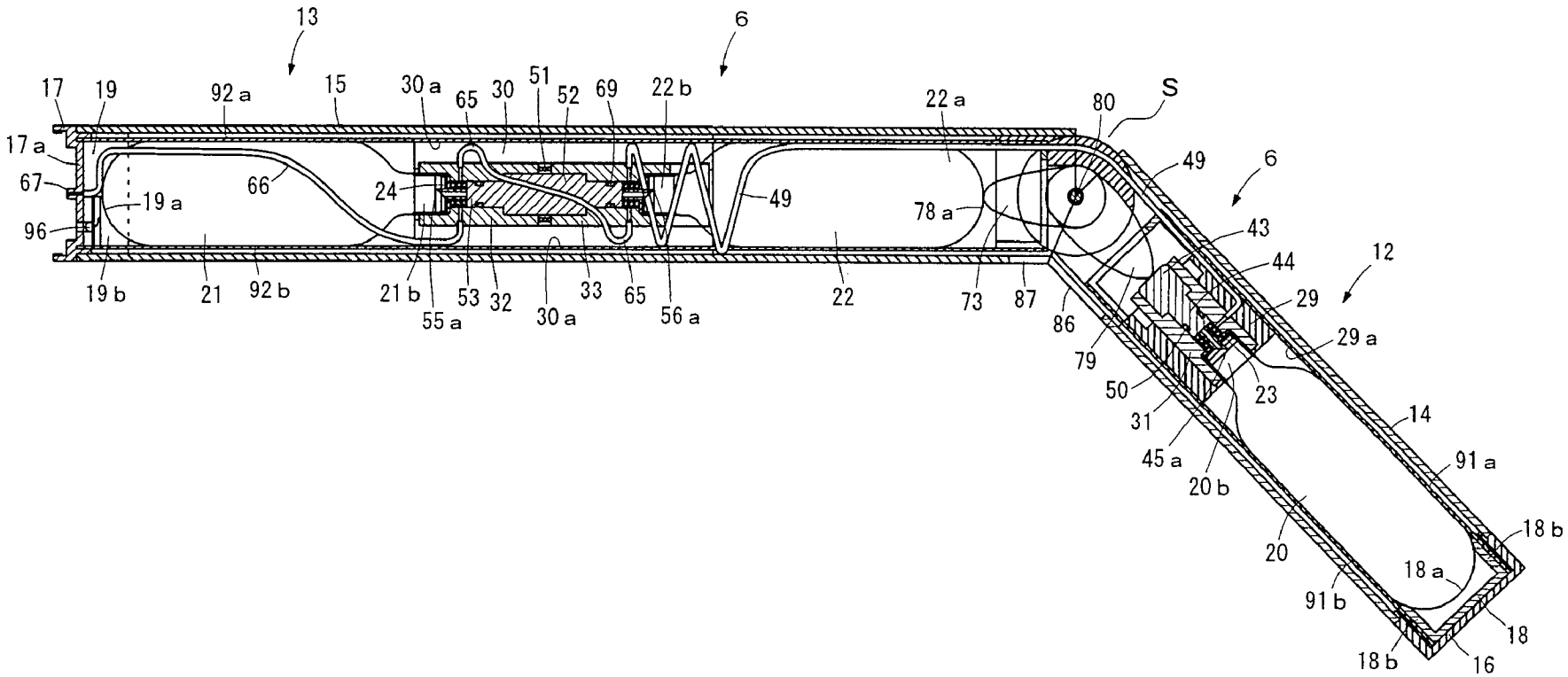
FIG. 16 is a cross-sectional view of the inside structure of the carbon dioxide fire extinguisher according to the present invention, which illustrates a state in which a fire extinguisher having a bent first cylindrical body is used.
Figure 17:
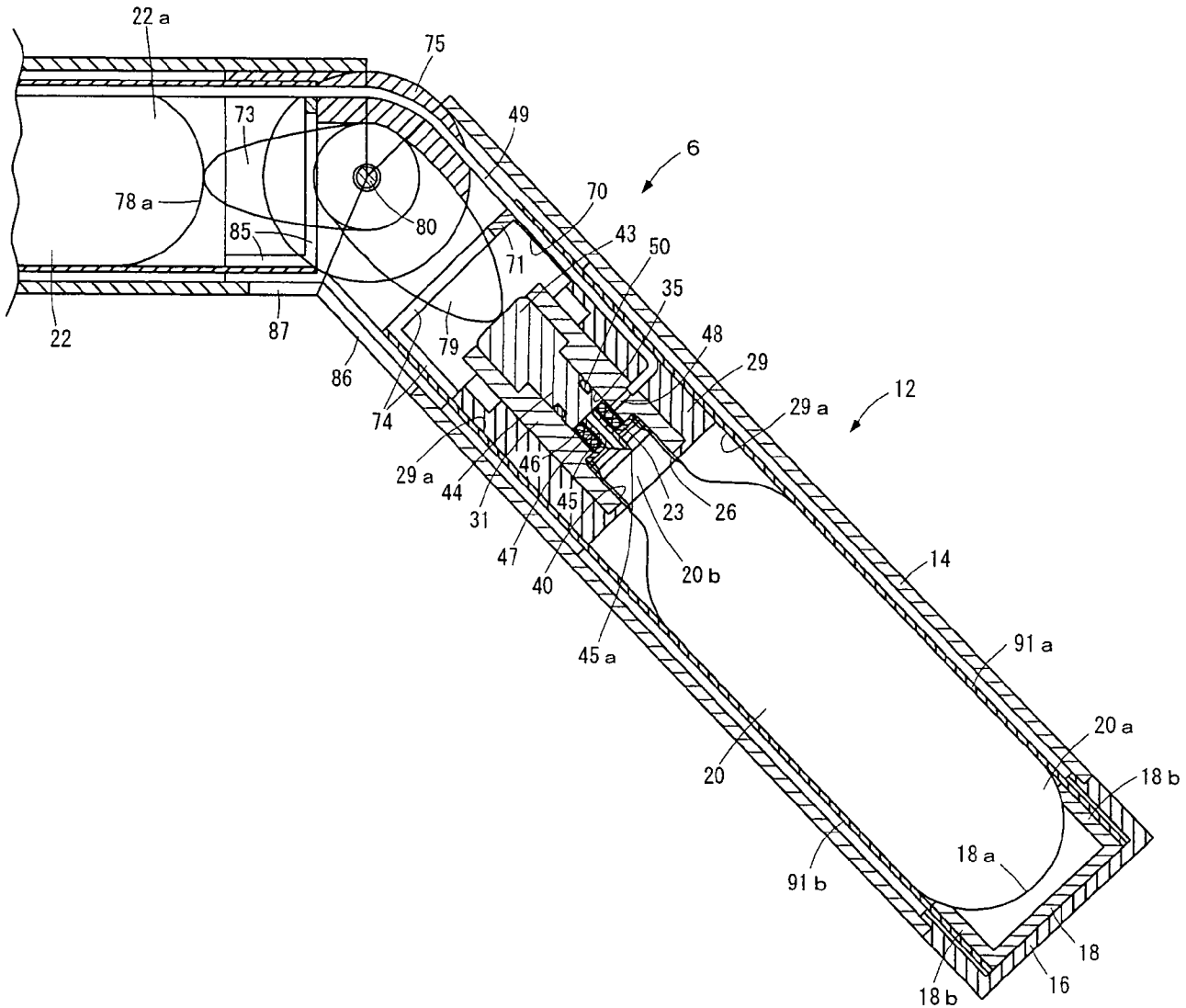
FIG. 17 is an enlarged cross-sectional view illustrating main portions of FIG. 16 and an inside structure of the first cylindrical body side.
Figure 18:
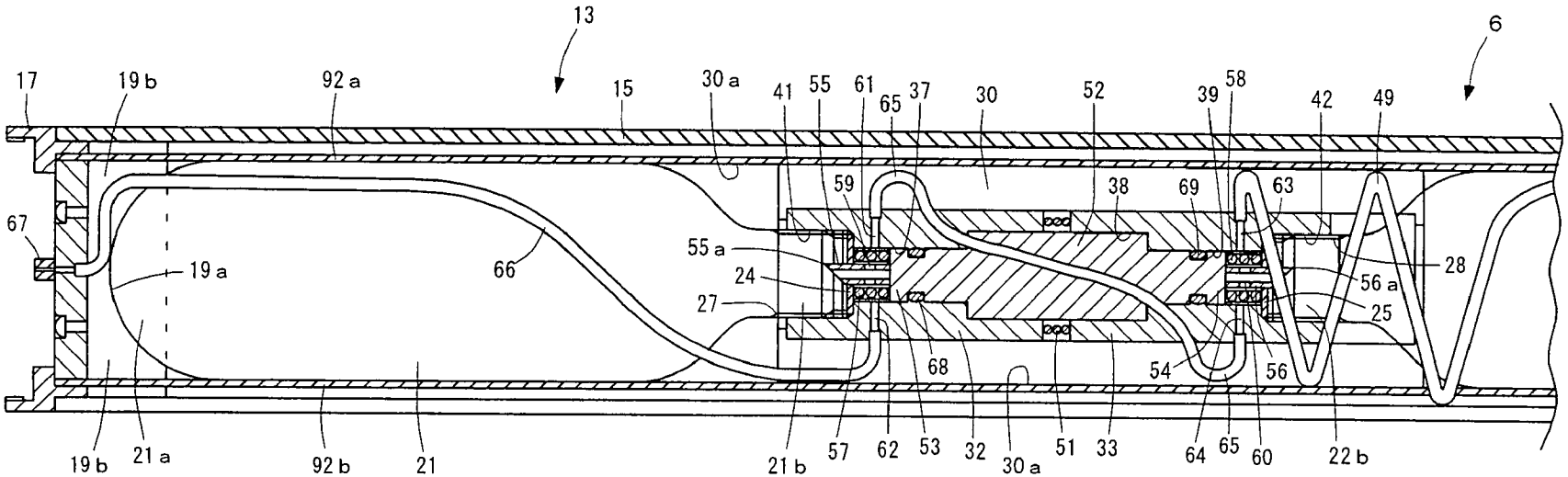
FIG. 18 is an enlarged cross-sectional view illustrating main portions of FIG. 16 and an inside structure of the second cylindrical body side.

This state is illustrated in FIGS. 16 to 18. As for this state, the first cam 73, which is fixed on the connecting portion S side of the first cylindrical body 12, and the cam plate 72 are rotated in the bending direction for the crossing angle θ of the obliquely cut portions 14*a*, 15*a* centering on the pin 80, that is, in the clockwise direction in FIG. 8.

Therefore, the first cam 73 is engaged with the bottom portion 22*a* of the gas cylinder 22 which is arranged closely to the cam 73, and the gas cylinder 22 is pushed and moved on the gas cylinder 21 side against the elasticity of the springs 51, 57, 58.

Further, second cams 79, 79, which are fixed at the coupling joint 75 of the second cylindrical body 13, are rotated relatively in the counter direction to the bending direction for the above-described crossing angle θ centering on the pin 80, to thereby engage the top end portions the cams 79, 79 with the head portion of the push rod 43 which is arranged closely to the cams 79, 79.

Therefore, the push rod 43 is pushed and moved on the gas cylinder 20 side against the elasticity of the spring 46.

As a result of this, the guide cylinder 33 screwed into the cylinder 22 is moved synchronously with the cylinder 22 against the elasticity of the springs 51, 57, 58, and the guide cylinder 33 is engaged with the slide rod 52, and pushed and moved on the gas cylinder 21 side together with the slide rod 52.

Therefore, the tip portion 55*a* of the needled tube 55 is approached and pierced to the sealing plate 24 of the gas cylinder 21, and the tip portion 56*a* of the needle tube 56 is approached and pierced to the sealing plate 25 of the gas cylinder 22. Further, the tip portion 45*a* of the needle tube 45 is approached and pierced to the sealing plate 23 of the gas cylinder 20 in accordance with moving the push rod 43.

At this time, guide cylinder 33 is closed to the guide cylinder 32, to thereby contact to the switch terminals 99, 100. Then, the feeding circuit is closed.

Accordingly, the lamp 96 provided at the top end portion of the second cylindrical body 13 is lighted, the illumination is radiated from the radiation hole 97 to the outside, to thereby illuminate around the origin of a fire.

Therefore, the fire extinguishing operation can be easily carried out under night or a power failure, and the light can be used as an evacuation guide light after extinguishing the fire.

In this way, the seals of the sealing plates 23 to 25 are simultaneously broken by the tip portions 45*a*, 55*a*, 56*a*, and carbon dioxide filled in the gas cylinders 20 to 22 are jetted from the needle tubes 45, 55, 56. Then, the jetted carbon dioxide are moved in the gas guide tubes to be joined together, and jetted from the nozzle 67 to the origin of a fire.

That is, when the seal of the sealing plate 23 is broken, carbon dioxide filled in the gas cylinder 20 is guided to the needle tube 45 to flow out. Then, carbon dioxide flows from the through hole 47 of the needle tube 45 to the guide hole 48 through the sliding hole 35, is moved in the gas guide tube 49 to flow into the guide hole 63 of the guide cylinder 33, and guided to the sliding hole 39.

Further, when the seal of the sealing plate 25 is broken, carbon dioxide filled in the gas cylinder 22 is guided to the needle tube 56 to flow out. Then, carbon dioxide is moved from the through hole 60 of the needle tube 56 to the sliding hole 39, and joined and mixed with carbon dioxide flowing out from the gas cylinder 20.

Then, the mixed carbon dioxide is moved in the gas guide tube 65 from the guide hole 64, flows into the guide hole 61 of the guide cylinder 32, and is guided to the sliding hole 37.

Further, when the seal of the sealing plate 24 is broken, carbon dioxide filled in the gas cylinder 21 is guided to the needle tube 55 to flow out. Then, carbon dioxide is moved from the through hole 59 of the needle tube 55 to the sliding hole 37, and joined and mixed with carbon dioxide flowing out from the gas cylinders 20, 22.

Then, the mixed carbon dioxide is moved in the gas guide tube 66 from the guide hole 66 to be guided to the nozzle 67, and jetted toward the origin of a fire from the nozzle 67.

At this time, a part of carbon dioxide is adiabatically expanded to become dry ice after jetting from the nozzle 67, and the dry-iced carbon dioxide is mixed with the gaseous carbon dioxide to be jetted to the origin of a fire.

Therefore, the temperature around the origin of a fire is lowered, and feeding oxygen to around the origin of a fire is intercepted, so that the fire extinguishing operation can be efficiently carried out, and the fire can be extinguished quickly.

Further, carbon dioxide of three gas cylinders 20 to 22 are jetted in one time, so that the fire extinguishing operation can be increased, and the fire can be extinguished accurately and quickly, as compared with the fire extinguishing operation with one gas cylinder.

At this time, carbon dioxide jetted from the gas cylinders 20 to 22 are jetted in the gaseous state, and flows out from the needle tubes 45, 55, 56 having comparatively large diameters to the small divided sliding holes 35, 37, 39, to thereby flow out to the gas guide tubes 49, 65, 66. Accordingly, the adiabatically expansion is carried out gradually and gently, to thereby prevent dry-icing or solidifying carbon dioxide in the moving processes.

Therefore, after jetting from the nozzle 67, carbon dioxide is not in dry ice form at all, and dry ice does not form in the area around the jet portion and, therefore, the jet portion does not become clogged. Accordingly, stable fire extinguishing operation can be obtained.

In this way, the fire extinguishing operation of the present invention can be carried out only by holding the fire extinguisher 6, releasing the joining ring 88, directing the second cylindrical body 13 toward the origin of a fire, in which the second cylindrical body 13 is one of the cylindrical bodies, and bending the first and second cylindrical bodies 12, 13. Accordingly, the operation is easy and the fire can be extinguished quickly.

Therefore, the complication of the conventional operation of the fire extinguisher can be solved. In the conventional operation, the safety plug is removed, the handle is operated to thereby lower the perforating needle, the seal of the sealing plate of the pressure gas cylinder is broken, and the jetting nozzle is directed toward the origin of a fire.

Further, the seal of the sealing plates 23 to 25 can be broken only by the bending operations of the first and second cylindrical bodies 12, 13. Accordingly, the operation is carried out safely and easily, as compared with the conventional fire extinguisher having the structure in which the electric ignition type squib is exploded.

Further, when the fire is extinguished, the carbon dioxide is jetted while directing the second cylindrical body 13 on the jetting side toward the origin of a fire. Accordingly, a remarkable physical strength is not necessary, as compared with the conventional fire extinguishing method which is complicated and needs physical strength, since the fire extinguishing chemical is jetted while holding the fire extinguisher which is large and heavy in one hand, and holding the nozzle in the other hand.

In addition, as for the fire extinguisher 6, the fire extinguishing operation is finished after jetting carbon dioxide from the gas cylinders 20 to 22.

Then, as for the used gas cylinders 20 to 22, related members of the fire extinguisher 6 are removed, the joint blocks 29, 30 are taken out from the outer cylinders 14, 15, the used gas cylinders are changed to new gas cylinders 20 to 22, the new cylinders are incorporated in the outer cylinders 14, 15, and a new joining ring 88 is mounted between connecting end portions of the first cylindrical bodies 12 and 13. Then, the fire extinguisher 6 can be reused. Furthermore, the used gas cylinders 20 to 22 can be reused by filling carbon dioxide again.

FIGS. 19 to 43 illustrate the other embodiments of the present invention, and same codes are used to parts corresponding to the above-described structure.

Figure 19:
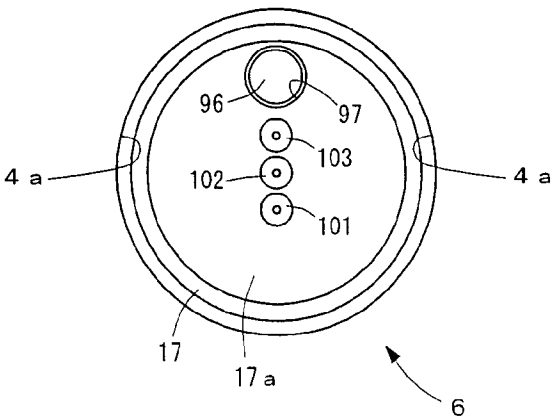
FIG. 19 is a plane view of a top end portion of the second cylindrical body of a carbon dioxide fire extinguisher according to a second embodiment of the present invention, which is enlarged a little.
Figure 20:
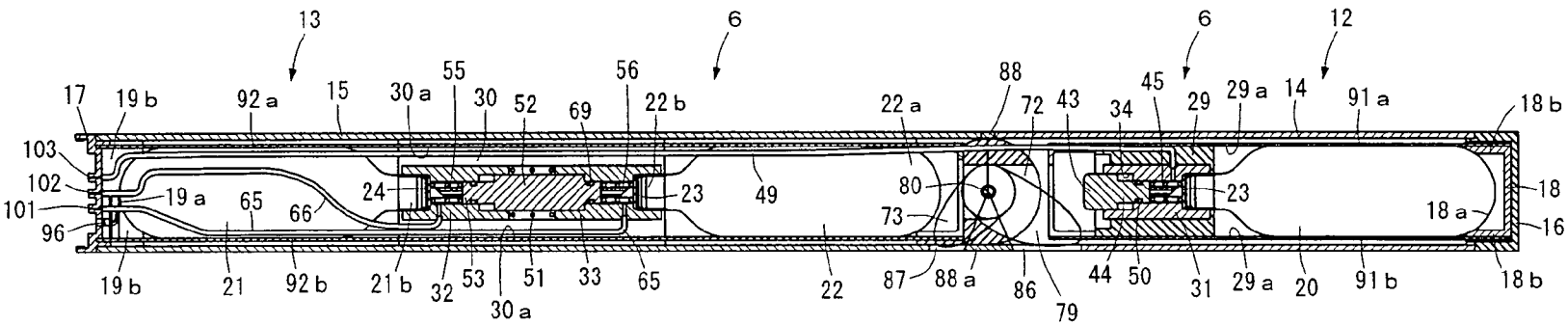
FIG. 20 is a longitudinal cross-sectional view of an inside structure of the carbon dioxide fire extinguisher according to the second embodiment of the present invention.

In the drawings, FIGS. 19 and 20 illustrates a second embodiment of the present invention. In this embodiment, three nozzles 101 to 103 are provided at the cap 17, the gas guide tubes 49, 65, 66 of the gas cylinders 20 to 22 are connected with the nozzles 101 to 103, and carbon dioxide in the gas cylinders 20 to 22 is jetted respectively. Accordingly, the accuracy of the fire extinguishing can be kept. Further, a jetting area of carbon dioxide can be increased since the nozzles 101 to 103 are increased, so that the fire extinguishing efficiency can be increased.

Figure 21:
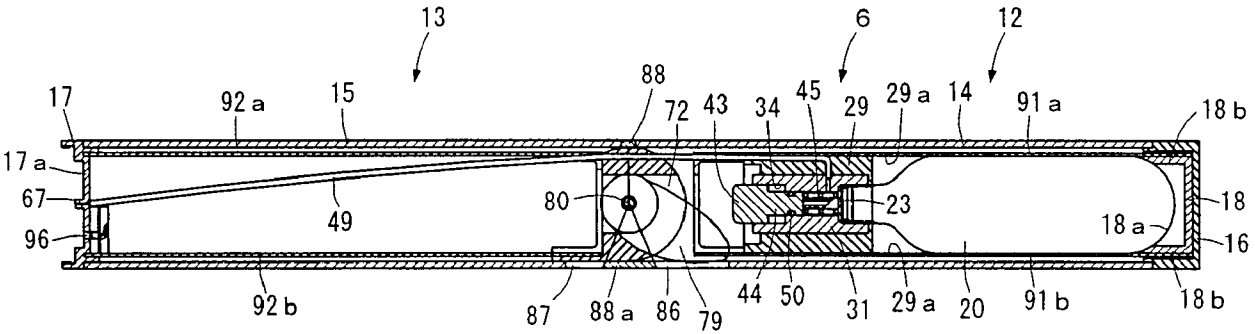
FIG. 21 is a cross-sectional view of an inside structure of the carbon dioxide fire extinguisher according to a third embodiment of the present invention.

FIG. 21 illustrates a third embodiment of the present invention. In this embodiment, the gas cylinders 21, 22, the joint block 30, the guide cylinders 32, 33, the gas guide tubes 65, 66 and the cam 73, which are in the second cylindrical body 13, are omitted. Carbon dioxide in the single gas cylinder 20 is guided to the nozzle 67 through the cam 79, the needle tube 45 and the gas guide tube 49, and then, jetted by bending the first cylindrical bodies 12, 13.

At this case, the outer cylinder 15 can have the small structure since the gas cylinders 21, 22 are removed. However, after considering the influence of radiant heat from the origin of a fire, the bending operativity and the jetting operation, the guide cylinder 15 has the structure having the same length as that of the outer cylinder 14.

Figure 22:
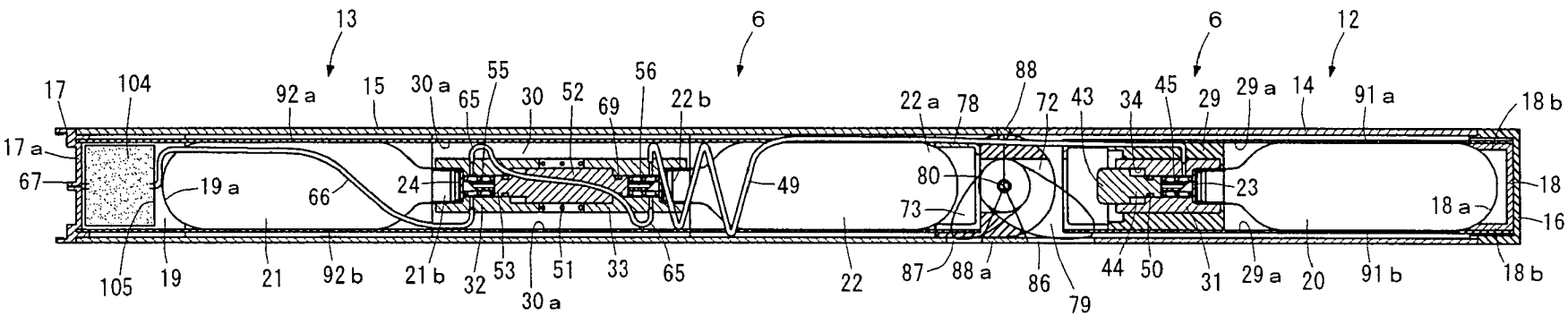
FIG. 22 is a cross-sectional view of an inside structure of a fire extinguisher having a powder fire extinguishing chemical according to a forth embodiment of the present invention.

FIG. 22 illustrates a firth embodiment of the present invention. In this embodiment, a container 105 filled with a powder fire extinguishing chemical 104 is housed between the cap 17 and the cylinder support 19 in the outer cylinder 15, and the container 105 is connected with the discharging side of the gas guide tube 66. Further, the container 105 and the nozzle 67 are communicated, carbon dioxide jetted from the gas cylinders 20 to 22 is guided to the container 105, and the powder fire extinguishing chemical 104 in the container 105 is pushed out to the nozzle 67, to thereby jet the chemical 104 to the origin of a fire from the nozzle 67.

At this case, as for carbon dioxide for pressuring, the jointed carbon dioxide of the gas cylinders 20 to 22, the respective carbon dioxide, or carbon dioxide of the single gas cylinders 20 to 22 may be guided to the container 105.

FIGS. 23 to 46 illustrate a fifth embodiment of the present invention. In this embodiment, an operation piece provided at the first cylindrical body 12 is released or raised up without bending the first and second cylindrical bodies 12, 13, and the cylindrical bodies 12, 13 are relatively rotated and operated. Accordingly, the seals of the sealing plates 23 to 25 of the gas cylinders 20 to 22 can be broken simultaneously, to thereby jet the filled gas at once.

That is, the fire extinguisher 6 is usually hooked and provided on the fire extinguisher holder 1. The fire extinguisher holder 1 is formed to have an approximately U-shaped cross section, and has locking projected portions 1*a*, 1*a* having an approximately ridge shaped cross section on both sides. The fire extinguisher 6 is vertically held between the locking projected portions 1*a*, 1*a*.

Locking claws 1*b*, 1*b* are cut and raised to be formed at upper and lower positions of the fire extinguisher holder 1, a hooking hole 6*b* formed on a mounting surface 6*a* of the fire extinguisher 6 is hooked at the locking claws 1*b*, 1*b*. In the drawings, 1*c* is a screw hole formed at the fire extinguisher holder 1. A screw 101 such as a wood screw or the like is inserted into the screw hole 1*c*, and screwed into the wall surface 2.

Figure 23:
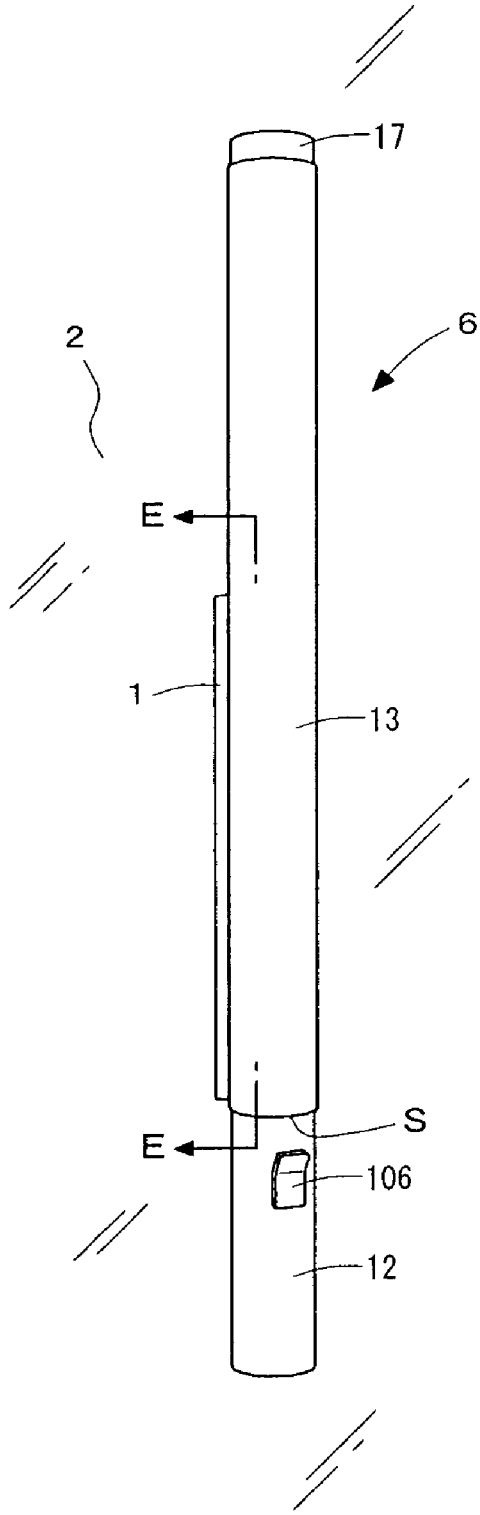
FIG. 23 is a front view illustrating an installing state of the carbon dioxide fire extinguisher according to a fifth embodiment of the present invention.

The fire extinguisher 6 is formed in an approximately cylindrical shape being longer than the fire extinguisher holder 1, and comprises the first cylindrical body 12 on the operation side, and the second cylindrical body 13 on the holding side. The fire extinguisher 6 is usually hooked at the fire extinguisher holder 1 while having the first cylindrical body 12 on the lower side and the second cylindrical body 13 on the upper side, as illustrated in FIG. 23.

Figure 24:
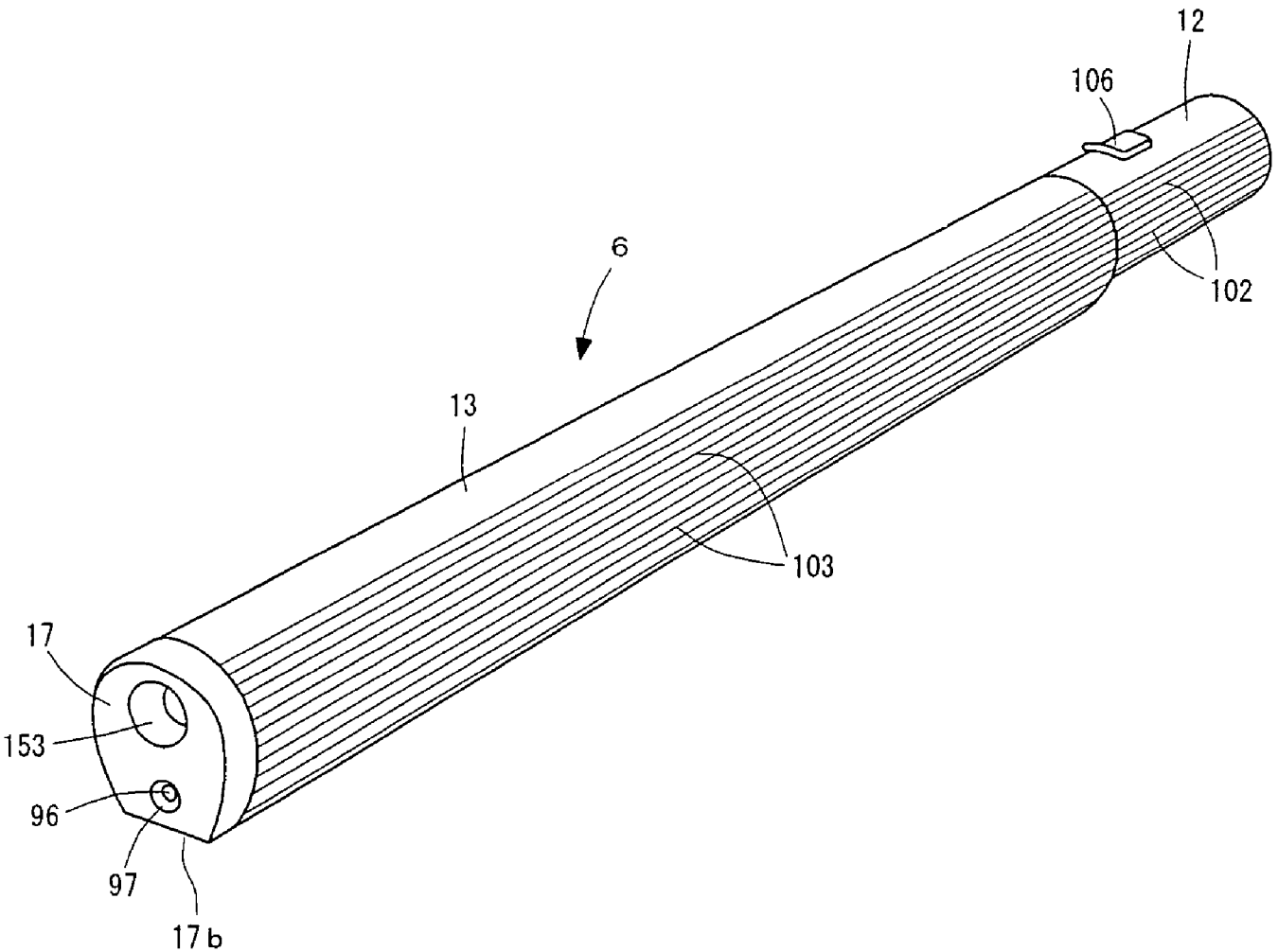
FIG. 24 is a perspective view illustrating an appearance of the carbon dioxide fire extinguisher according to the fifth embodiment.
Figure 25:
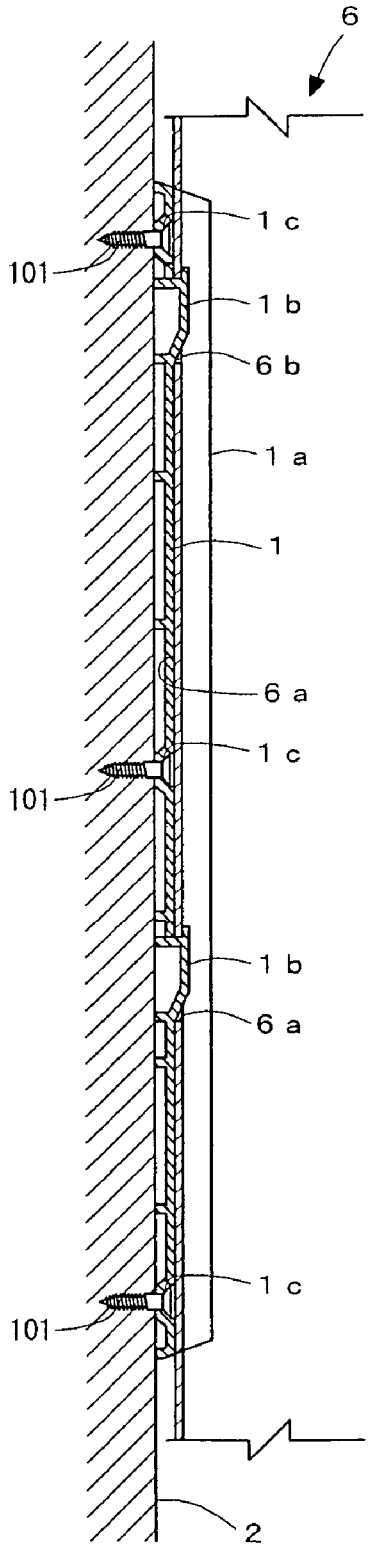
FIG. 25 is an enlarged cross-sectional view taken along the E-E line of FIG. 23.
Figure 26:
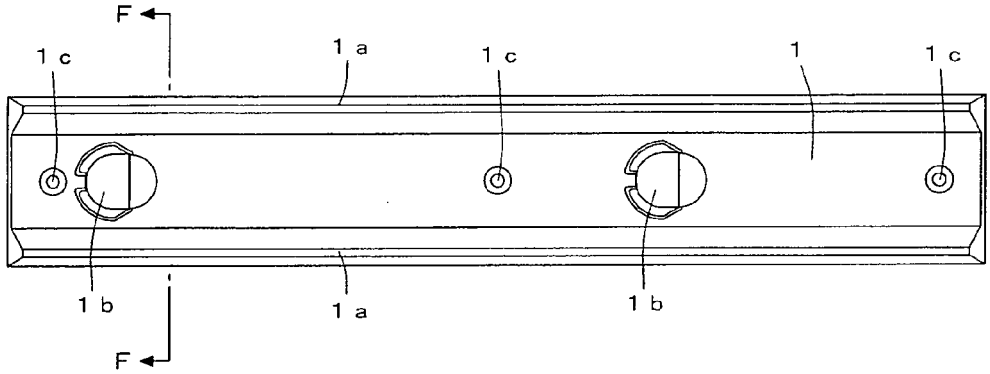
FIG. 26 is a plane view illustrating a fire extinguisher according to the fifth embodiment by enlarging it.
Figure 27:
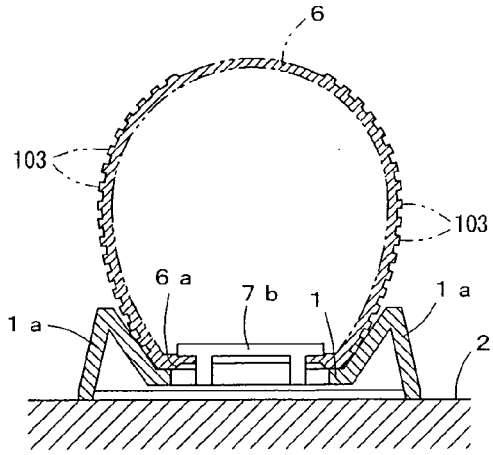
FIG. 27 is an enlarged cross-sectional view taken along the F-F line of FIG. 26.
Figure 28:
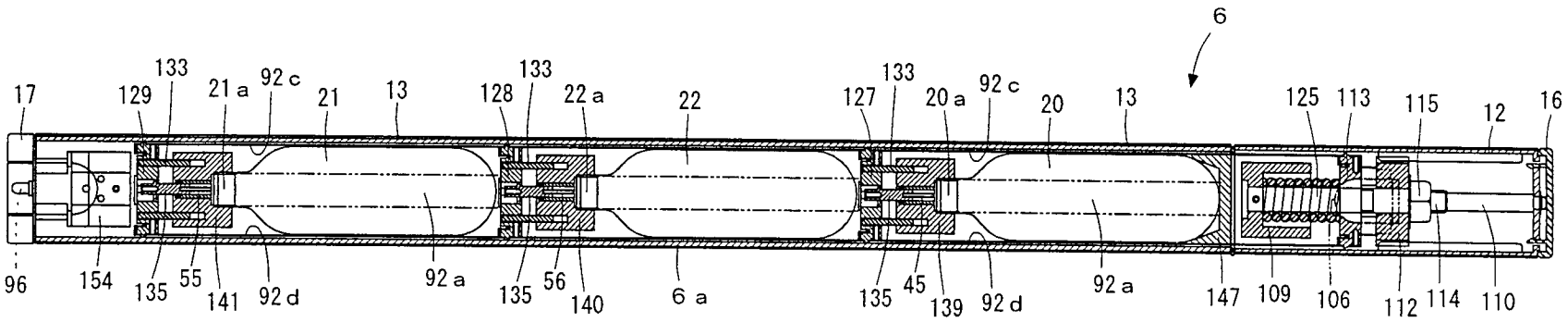
FIG. 28 is a transverse cross-sectional view of the carbon dioxide fire extinguisher according to the fifth embodiment.
Figure 29:
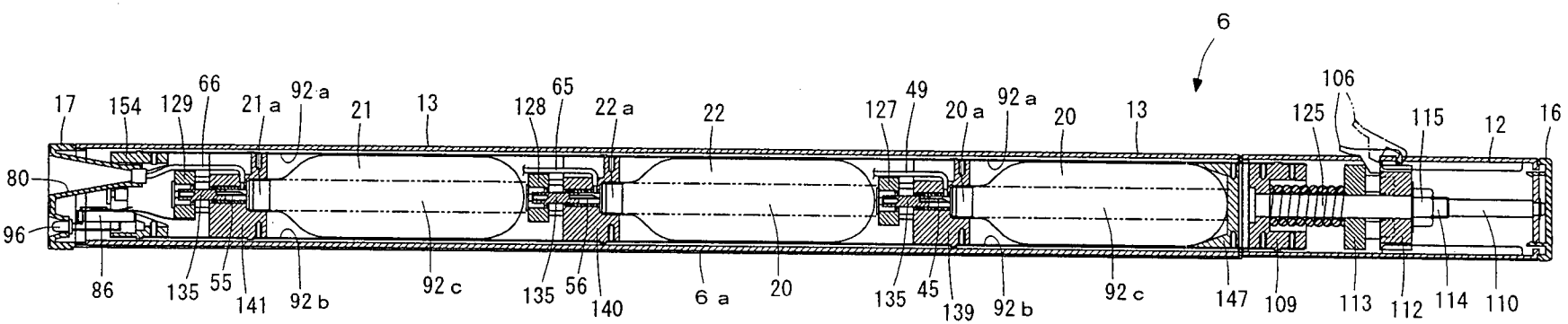
FIG. 29 is a longitudinal cross-sectional view of the carbon dioxide fire extinguisher according to the fifth embodiment.
Figure 30:
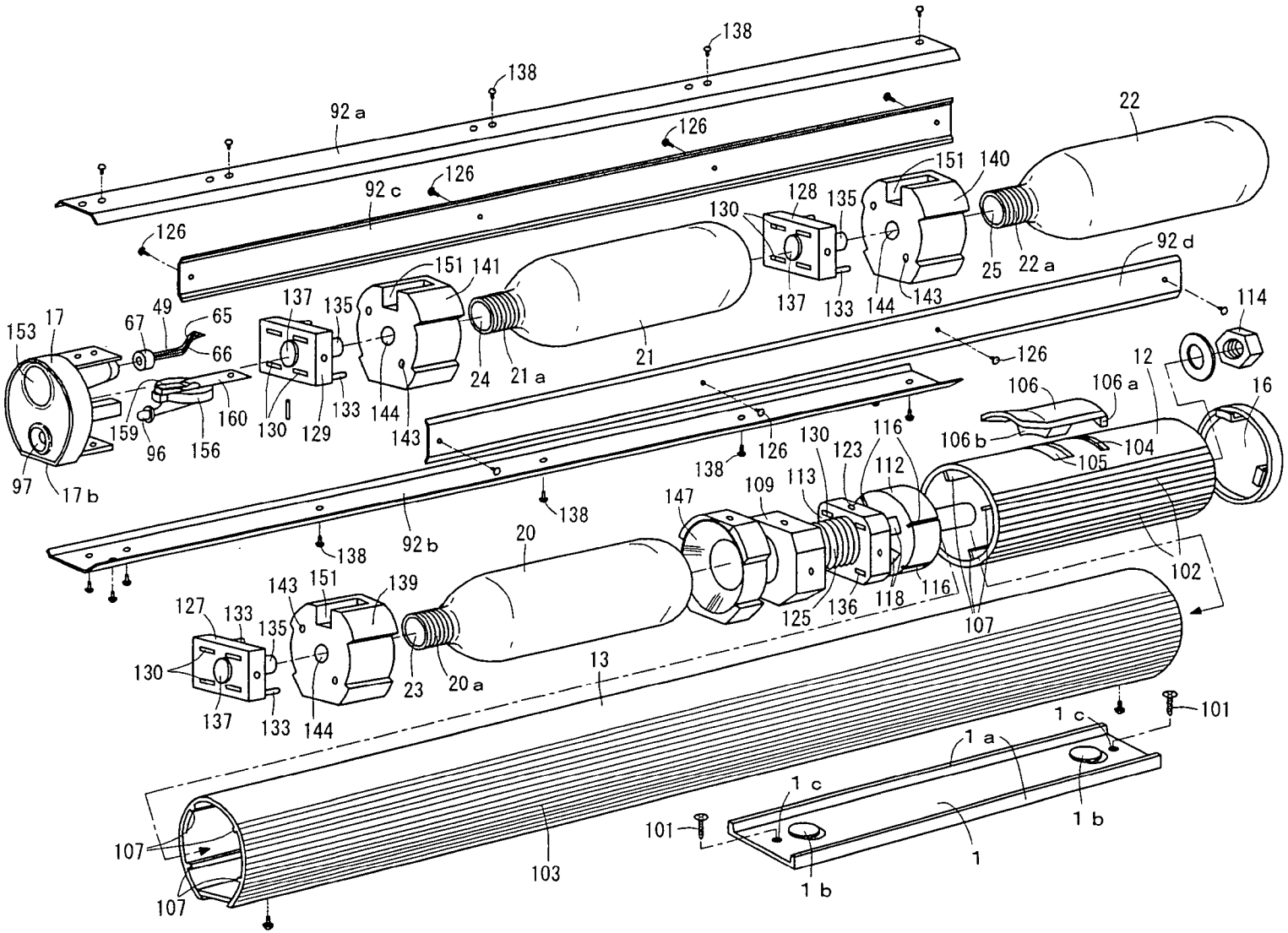
FIG. 30 is a perspective view illustrating a state in which main portions of the carbon dioxide fire extinguisher according to the fifth embodiment of the present invention are decomposed.

The fire extinguisher 6 in this embodiment is structured to have the whole length of about 730 mm and the diameter of about 50 mm. As for the cross section of the fire extinguisher 6, the first cylindrical body 12 is formed in a circular cross section, the second cylindrical body 13 is formed in a horseshoe shaped cross section having the length ratio of these cross sections being approximately 1:4, as illustrated in FIG. 24.

In the drawings, 102, 103 are beads for friction formed in the axial direction on the circumference surfaces of a part of the first and second cylindrical bodies 12, 13. 104, 105 are two large and small notch grooves formed on the circumference surface of the first cylindrical body 12. Operation pieces 106 made of aluminum or a synthetic resin are releaseably mounted on the grooves 104, 105.

A locking claw 106*a* is bent and formed at a base end portion of the operation piece 106, and a lock claw 106*b* is projected at a middle portion of the locking claw 106*a*. The locking claw 106*a* is inserted into the notch groove 104, and the lock claw 106*b* is inserted into the notch groove 105. By the lock claw 106*b*, a starting operation for breaking the seals of the gas cylinders 20 to 22 can be prevented.

Two pairs of large connecting plates 92*a*, 92*b* and 92*c*, 92*d* are opposedly arranged at equal angular positions in the first and second cylindrical bodies 12, 13, where the two pairs of the connecting plates 92*a*, 92*b* and 92*c*, 92*d* are on the upper and lower sides, and on the right and left sides respectively. These connecting plates are formed by steel plates to have an approximately roof shape or an approximately flat plate shape.

In these connecting plates, the connecting plates 92*a*, 92*b* are fixed by the screw at suitable positions on the inner surface of the cylindrical body 12. Further, the connecting plates 92*c*, 92*d* are slidably arranged in the axial direction along one pair of guides 107, which are projected inside the cylindrical body 12.

A spring support 109, which is a fixing member made of a die-cast aluminum, is fixed at the connecting plates 92*a*, 92*b* by a screw 108, where the plates 92*a*, 92*b* are arranged inside the first cylindrical body 12. One end of a guide rod 110 is hooked at the spring support 109.

Another end of the guide rod 110 is fixed on an end surface on the closed side of the first cylindrical body 12 through a retaining ring 111, and a click plate 112 made of a die-cast aluminum is rotatively fitted to the guide rod 110. Further, a clutch plate 113, which is a movable body made of a die-cast aluminum and fitted adjacent to the click plate 112, is slidably fitted to the guide rod 110.

A screw portion 114 is provided at a middle portion of the guide rod 110. A nut 115 is screwed to the screw portion 114 as a stopper, and engaged with an end surface of the click plate 112, to thereby control moving the click plate 112 and the clutch plate 113.

At this case, a pin can be pressed and fitted instead of the nut 115. If the pin is used, number of parts is decreased, and a machining process of the screw portion 114 can be omitted.

The click plate 112 is formed to a disc shape having the thickness, and has a plurality of a recessed groove 116 in the axial direction on the circumference surface thereof. A locking piece 117 projected on the inner surface of the first cylindrical body 12 is fitted to the recessed groove 116, and rotating force of the first cylindrical body 12 is transmitted to the click plate 112 and thereby, the click plate 112 is rotatable.

A plurality of a dog holes 118 are formed on an end surface on another side of the click plate 112, and a plurality of dogs 119 projected at the clutch plate 113 are engageably provided at the dog holes 118.

The clutch plate 113 is formed in a rectangular plate shape having a wall thickness. Surfaces on the both sides of the clutch plate 113 are fixed at the connecting plates 92*c*, 92*d* through a screw 120, and a plurality of notch grooves 121 is formed on a front end surface of the clutch plate 113. A bending piece 122 formed by cutting and raising specific portions of the connecting plates 92*c*, 92*d* is engaged with the notch groove 121.

In the drawings, 123 is a projected portion projected on the circumference surface of the clutch plate 113, and the projected portion 123 is engaged into through holes (these are not illustrated in the drawings) of the connecting plates 92*c*, 92*d*.

The dog 119 is usually positioned by shifting a phase with the dog hole 118. The dog 119 is arranged engaging with another side surface of the click plate 112, a space 124 having the same length of the dog 119 is formed between the dogs 119, and the lock claw 106*a* is engaged into the Space 124.

A strong spring 125 is inserted between the spring support 109 and the clutch plate 113, to thereby movably energize the clutch plate 113 toward the click plate 112 side through the elasticity of the spring 125.

Further, when seal breaking operations of the gas cylinders 20 to 22 are carried out, the operation piece 106 can be released, the lock claw 106*a* can be pulled up from the space 124, the first cylindrical body 12 is rotated at about 45° to thereby simultaneously rotate the click plate 112, and the position of dog 118 can be facilitated to the dog 119.

Then, the clutch plate 113 is moved by the elasticity of the spring 125, the dog 119 is fitted to the dog hole 118, so that the connecting plates 92*c*, 92*d* fixing the clutch plate 113 can move a part of the space 124.

A plurality of movable blocks 127 to 129 is mounted at predetermined positions of the one pair of the connecting plates 92*c*, 92*d* through a screw 126, in which the movable blocks 127 to 129 are needle tube holders made of a die-cast aluminum and are mounted at equal intervals.

The movable blocks 127 to 129 are formed to have substantially same structures, and have a plurality of a notch groove 130 formed on front end surfaces thereof. Further, a bending piece 131 formed by cutting and raising predetermined portions of the connecting plates 92*c*, 92*d* is engaged with the notch groove 130.

In the drawings, 132 is projected portions projected on the circumference surfaces of the movable blocks 127 to 129, and are engaged into through holes (these are not illustrated in the drawings) of the connecting plates 92*c*, 92*d*.

One pair of guide pins 133, 133 is projected at a diagonal position of the movable blocks 127 to 129, and have a recessed hole 134 formed at a center of an end surface of one side thereof. A shaft shaped slide rod 135 made of a brass or steel is hooked at a deep portion of the recessed hole 134, and a fixing screw 137 is screwed into a screw portion 136 at the shaft end portion of slide rod 135, to thereby fix the slide rod 135.

Needle tubes 45, 55, 56 made of a brass or a steel tube are projected at a top end portion of the slide rod 135, so that tip portions 45*a*, 55*a*, 56*a* can pierce the sealing plates 23 to 25 of the gas cylinders 20 to 22. In this embodiment, the tip portions 45*a*, 55*a*, 56*a* are arranged at centers of the sealing plates 23 to 25, to thereby carry out the seal breaking smoothly and efficiency.

On the other hand, a plurality of joint blocks 139 to 141 made of a die-cast aluminum is mounted at equal intervals at predetermined positions of one pair of the connecting plates 92*a*, 92*b* through a screw 138.

In the drawings, 142 is a projected portion on circumference surfaces of the spring support 22, the joint blocks 139 to 141 and a supporting housing which is described below. The projected portion 142 is engaged with through holes (these are not illustrated in the drawings) of the connecting plates 92*a*, 92*b*.

The joint blocks 139 to 141 are formed to have substantially same structures, and have a guide hole 143 capable of inserting the guide pin 133 and a through hole 144 capable of inserting the slide rod 135 on a front end surface thereof.

The guide pin 133 and the slide rod 135 are inserted into the guide hole 143 and the through hole 144, and the movable blocks 127 to 129 and the joint blocks 139 to 141 are usually separated forming a space 145 which is approximately same as the space 124.

Screw holes 146 are formed at centers of rear end surfaces of the joint blocks 139 to 141, and the screw portions 20*a* to 22*a* of the mouth potions of the gas cylinders 20 to 22 are screwed into the screw holes 146, to thereby mount the screw portions 20*a* to 22*a* in the same direction. In the drawings, 147 is a cylinder support made of the synthetic resin, which uses a cap mounted at the rear end portion of the second cylindrical body 13, and is formed with a resin in an approximately dish shape.

A stepped hole 148 communicated with the through hole 144 is formed at a deep portion of the screw hole 146, a tube shaped collar 149 is mounted on the stepped hole 148, and the slide rod 135 is slidably fitted in the collar 149. In the drawings, 150 is an O-ring inserted between the deep portion of the stepped hole 148 and the deep portion of the collar 149.

Recessed portions 151 are formed on upper surfaces of the joint blocks 139 to 141, and guide holes 152 communicated with a middle portion of the collar 149 are formed on bottom surfaces of the recessed portions 151. One ends of the gas guide tubes 49, 65, 66, which are made of a steel tube capable for bending, are connected with the guide holes 152, and another ends are connected with the nozzle 67 made a brass or steel.

The cap 17 is formed to have an approximately horseshoe cross section and a small cylindrical shape. In this embodiment, the cap 17 is colored to red, and a rear end portion thereof is fitted and provided at the front end portion of the second cylindrical body 13.

A gas jetting port 153 having an approximately trumpet shaped cross section and an irradiation port 97 are opened at upper and lower positions on a front end surface of the second cylindrical body 13, and the nozzle 67 and a LED 96 which is used as a light, are mounted at rear end portions of these ports.

A support housing 154 made of a synthetic resin is arranged at a position close to the second cylindrical body 13, and the housing 154 is fixed at top end portions of the connecting plates 92*a*, 92*b* through a screw 155.

A cell 156, which is used as a power source, is mounted at a lower portion of the support housing 154, and lead wires 157, 157 conducting to the cell 156 are connected with a lamp case 158 of the LED 96.

Connecting terminals 159, 160 having plate spring shapes are arranged at a position close to the cell 156 by putting an insulation film between the terminals, and the terminals are arranged to be conductive and movable separate each other. Another end of the connecting terminal 160, which is on the movable side, is mounted at the lower end portion of the movable block 129.

The connecting terminals 159, 160 are usually intercepted conducting by the insulation film put between those. When the seal breaking operations of the gas cylinders 20 to 22 are carried out, the movable block 129 is moved, the connecting terminal 160 is moved separating from the connecting terminal 159 to pass through the insulation film, and the connecting terminals 159, 160 are contacted, to thereby light the LED 96.

The fire extinguisher 6 in this embodiment has an elongated rod shape, an excellent appearance as illustrated in FIG. 24, and light weight of about 1.5 kg. Accordingly, the fire extinguisher 6 can be easily handled, for example, carrying, operating or the like, as compared with the conventional fire extinguisher.

In the case of packing the fire extinguisher 6, since it has the elongated rod shaped, the small size and the light weight as described above, many fire extinguishers 6 can be packed rationally with a low cost.

In the case of conveying the packed fire extinguisher 6, there is a problem that the first cylindrical body 12 is given the rotating force by vibration or shock.

However, the dog 124 of the clutch plate 113*s* presses the front end surface of the click plate 112 by the elasticity of the spring 125, to thereby control rotating the click plate 112. Further, the lock claw 106*a* of the operating piece 106 is engaged between the click plate 112 and the clutch plate 113, to thereby prevent engaging the dog 124 with the dog hole 118.

Therefore, since the first cylindrical body 12 is turn-locked and moving the clutch plate 113 is prevented, there is no problem that the seals of the gas cylinders 20 to 22 are broken at the time of conveying, so that the fire extinguisher 6 may be safely transported and stored.

Then, when the fire extinguisher 6 is provided at, for example, the wall surface 2, the fire extinguisher holder 1 is mounted at the predetermined position of the wall surface 2 through the screw 101, the second cylindrical body 13 is inserted upwardly between the locking projected portions 1*a*, 1*a* of the holder 1, and the through hole 6*b* formed on the mounting surface 6*a* is hooked at the locking claw 1*b*. This state is illustrated in FIGS. 23 and 24.

As for the provided fire extinguisher 6, the clutch plate 113 is energized toward the cap 16 side by the elasticity of the strong spring 125, and the dog 119 is removed from the dog hole 118 to be engaged with the front end surface of the click plate 112. Then, the space 124 is formed between the click plate 112 and the dog 119, and the lock claw 106*a* of the operation piece 106 is engaged into the space 124.

Therefore, moving the clutch plate 113 is prevented, to thereby prevent moving the connecting plates 92*c*, 92*d* mounted on the circumference surface of the clutch plate 113.

The operating piece 106 is mounted on the outer circumference surface of the middle portion of the first cylindrical body 12, and the holding portion is positioned at the upper part of the operation piece 106 and warped a little toward the outside. This state is illustrated in FIG. 23.

Figure 31:
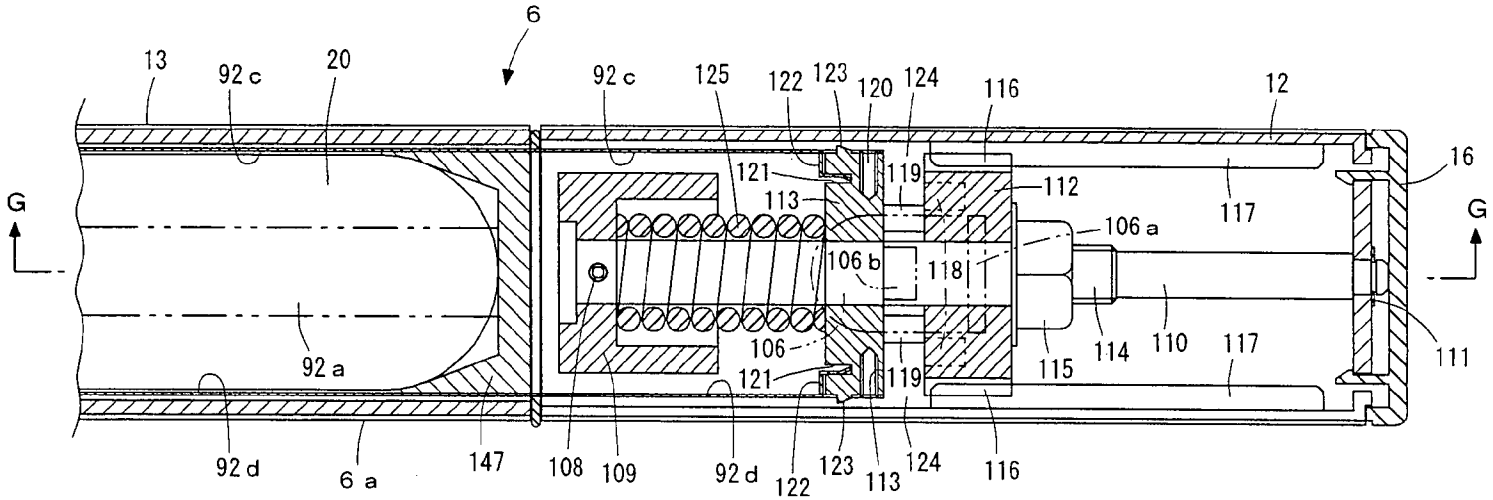
FIG. 31 is an enlarged cross-sectional view illustrating the main portions of FIG. 28 and the inside structure of the first cylindrical body before a seal breaking operation.
Figure 32:
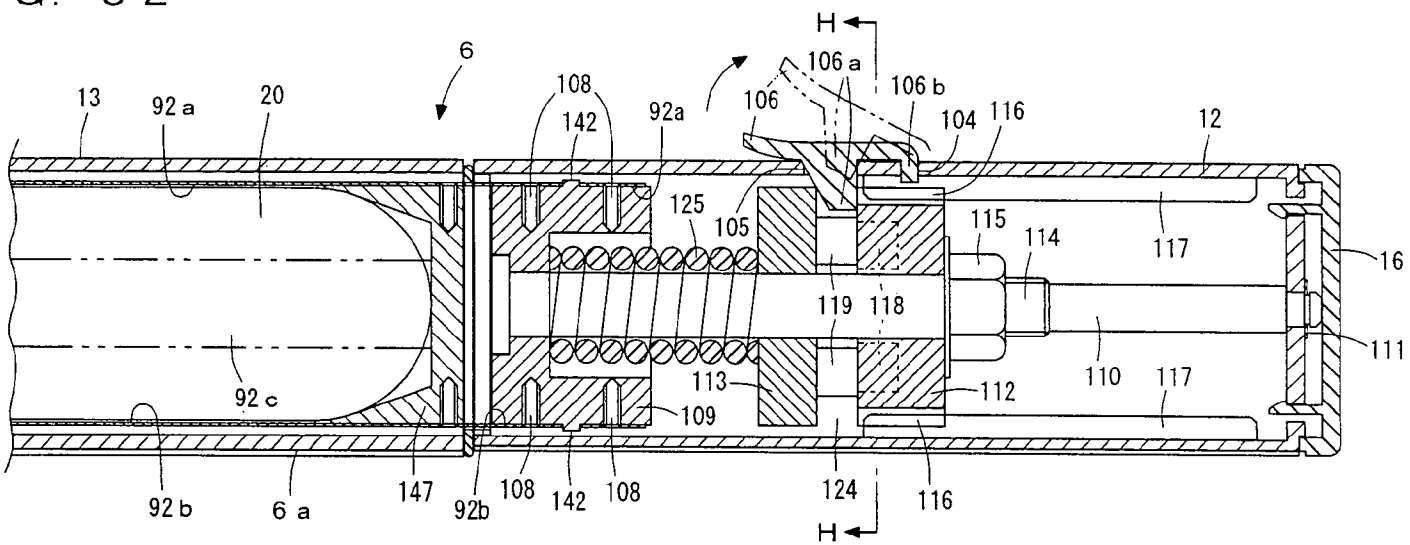
FIG. 32 is a cross-sectional view taken along the G-G line of FIG. 31.
Figure 33:
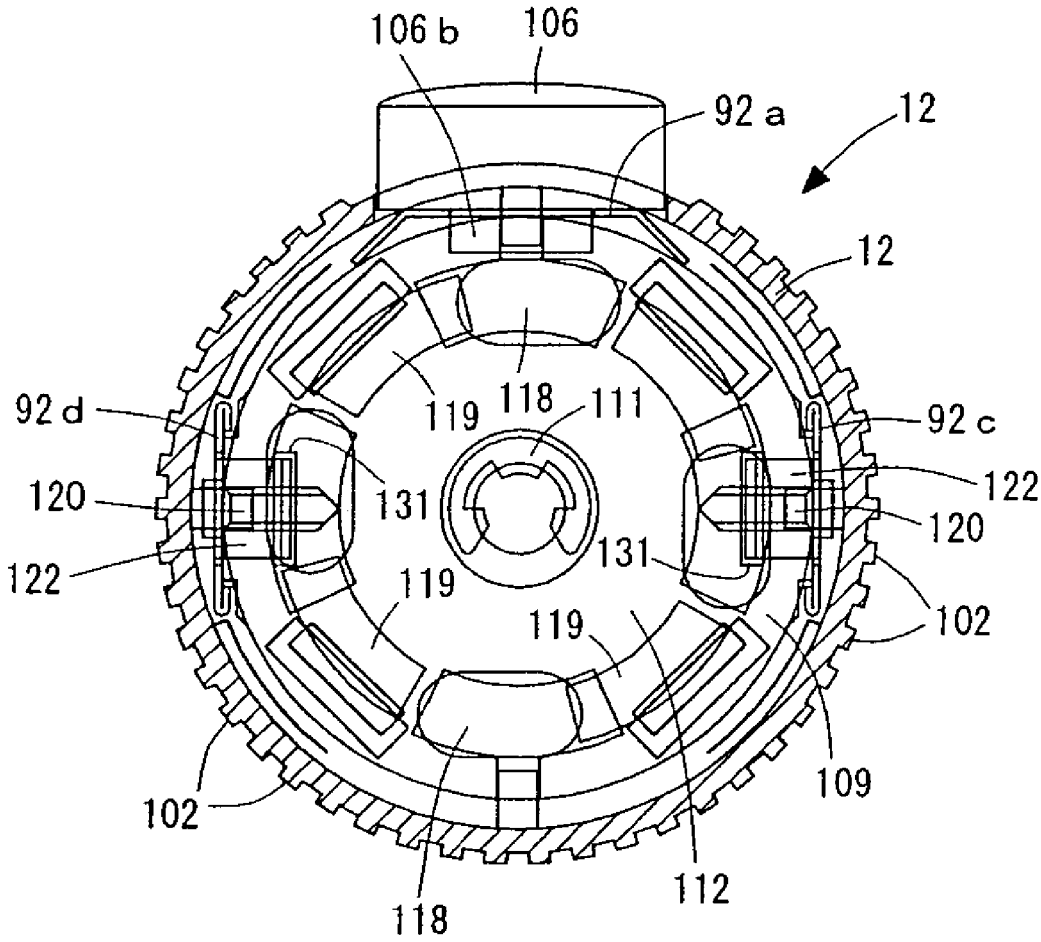
FIG. 33 is a cross-sectional view taken along the G-G line of FIG. 32.
Figure 34:
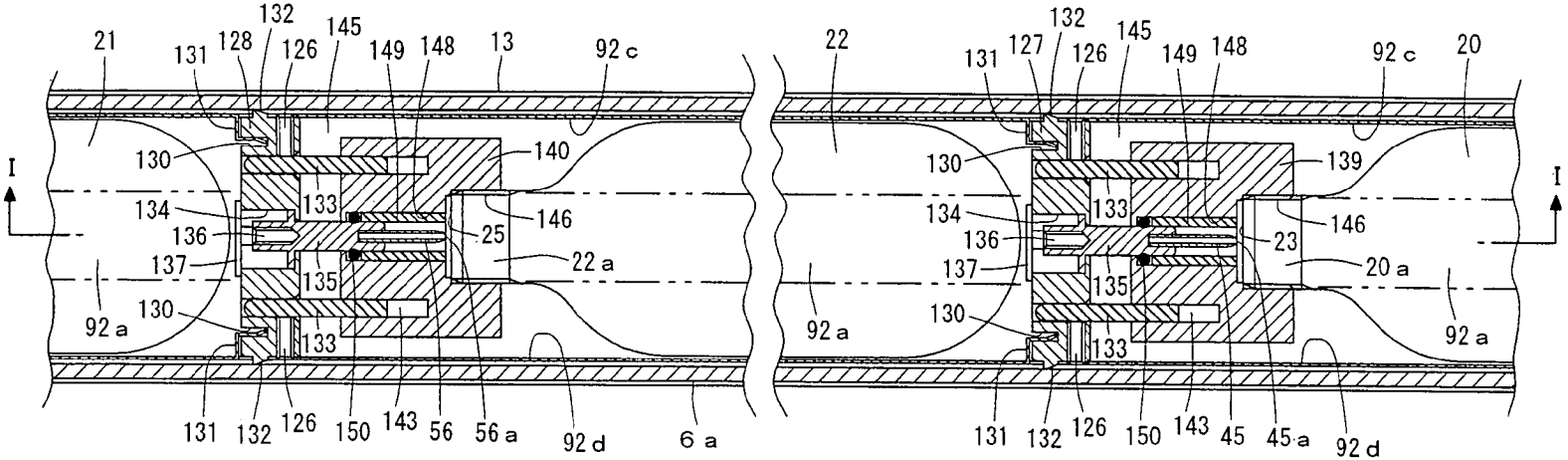
FIG. 34 is an enlarged cross-sectional view illustrating the main portions of FIG. 28 and an inside structure of a middle portion of the second cylindrical body before the seal breaking operation.
Figure 35:
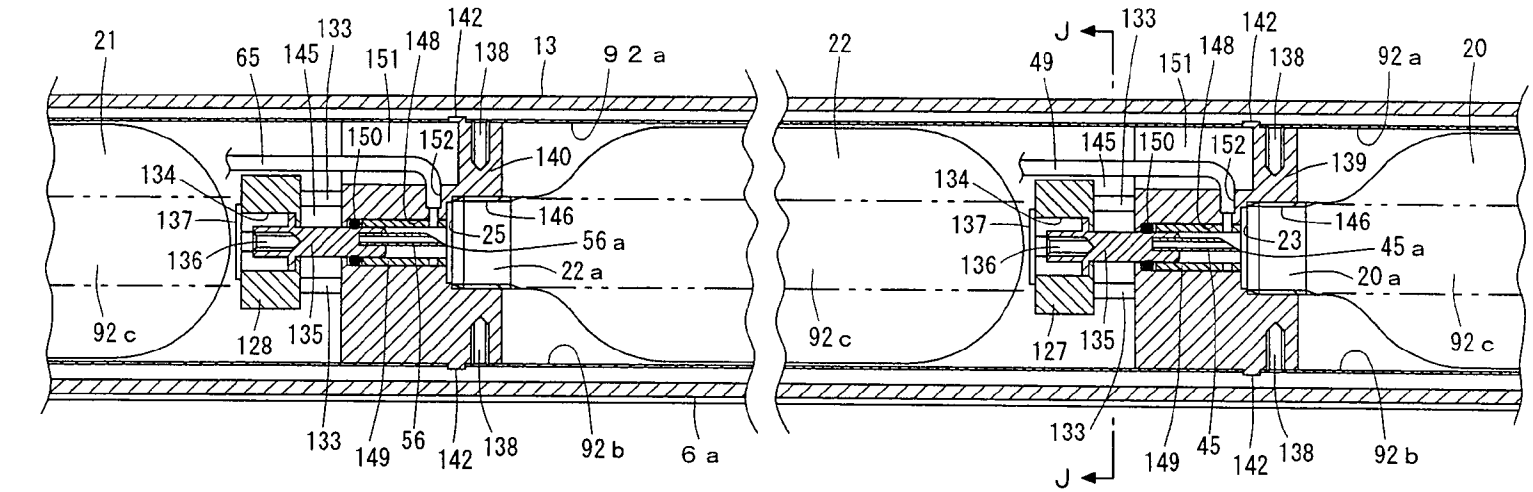
FIG. 35 is a cross-sectional view taken along the I-I line of FIG. 34.
Figure 36:
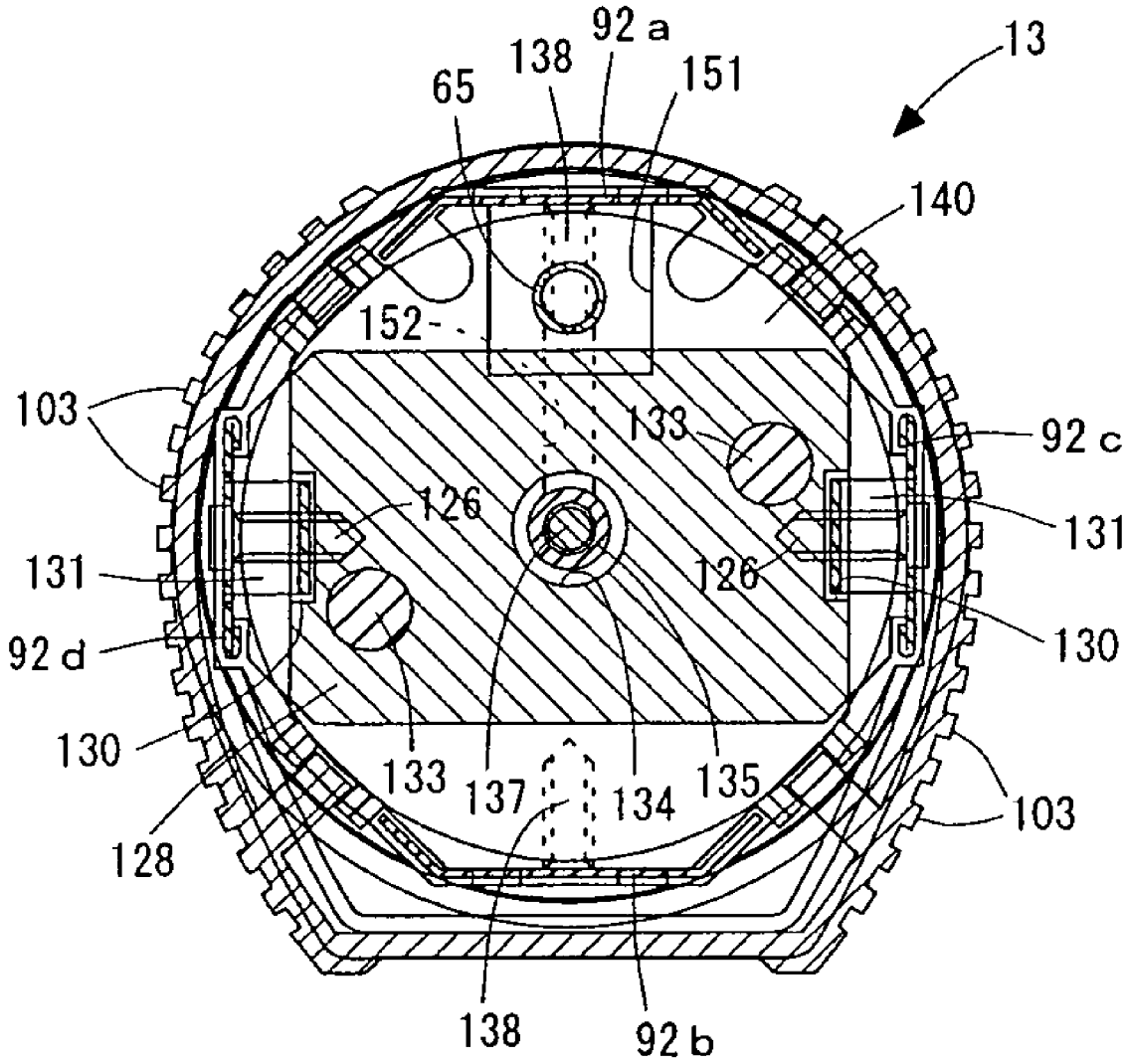
FIG. 36 is a cross-sectional view taken along the J-J line of FIG. 35.
Figure 37:
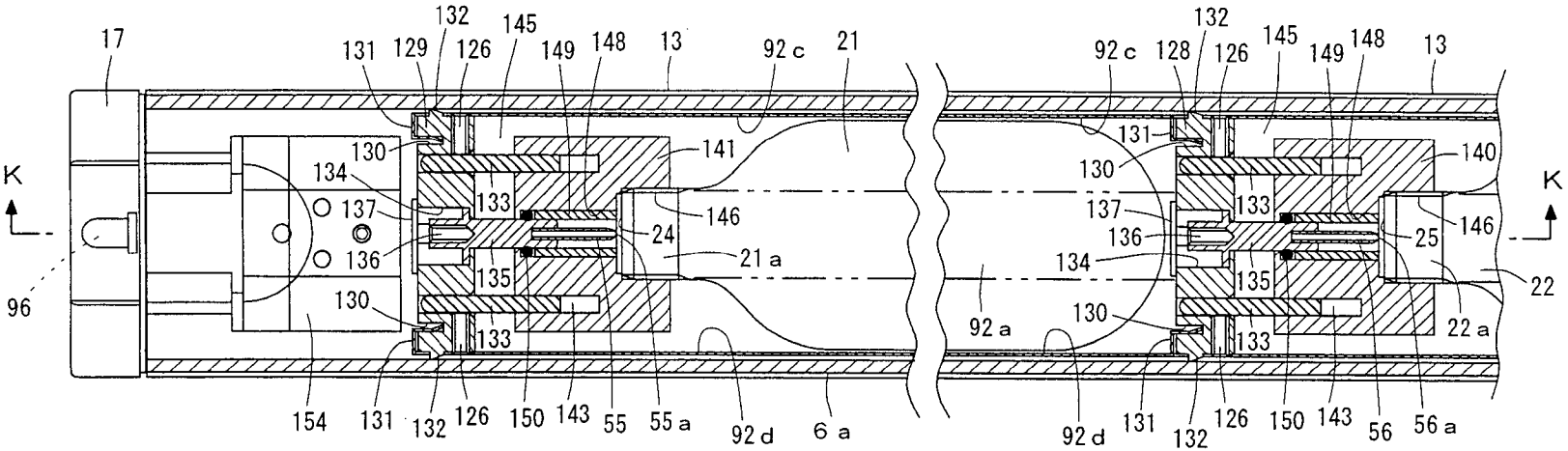
FIG. 37 is an enlarged cross-sectional view illustrating the main portions of FIG. 28 and an inside structure of a top end portion of the second cylindrical body after the seal breaking operation.
Figure 38:
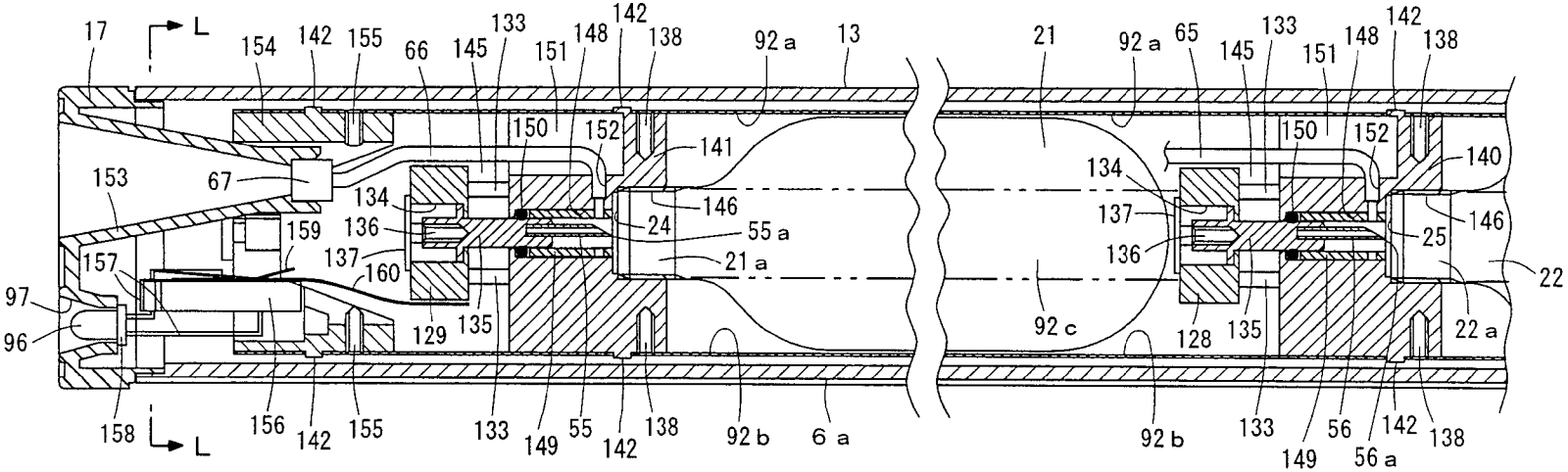
FIG. 38 is a cross-sectional view taken along the K-K line of FIG. 37.
Figure 39:
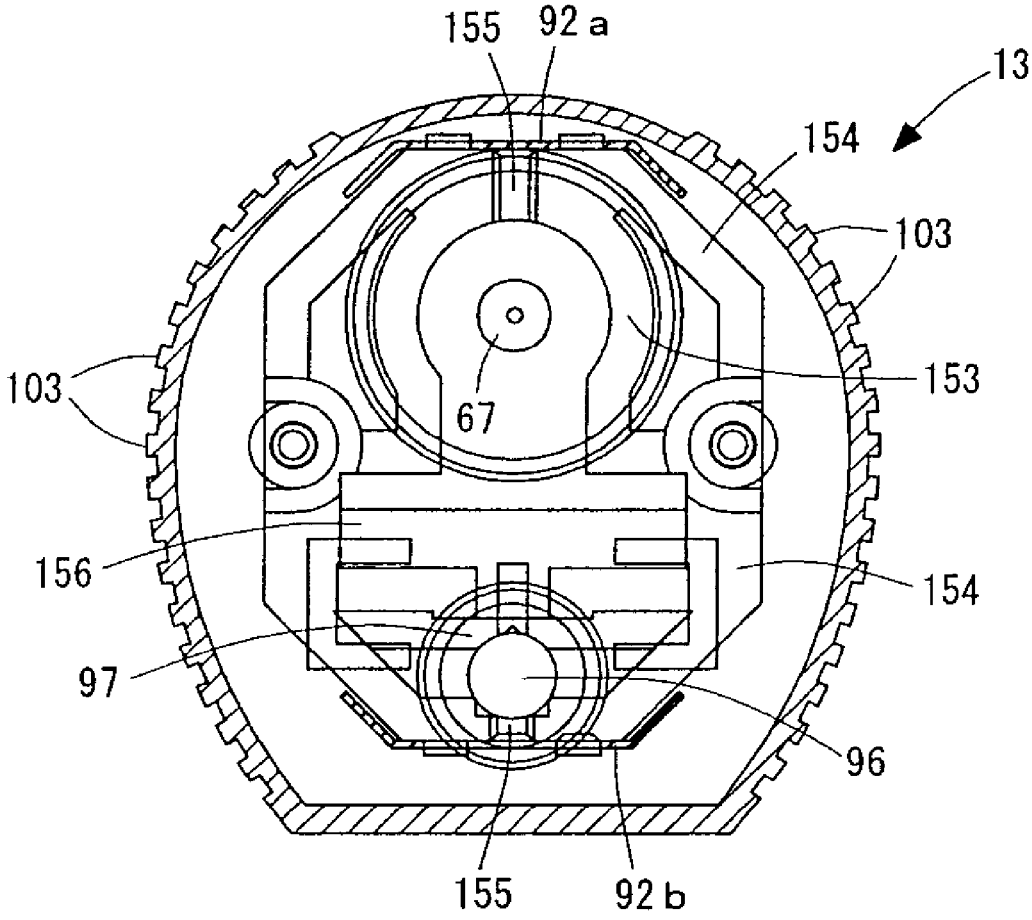
FIG. 39 is a cross-sectional view taken along the L-L line of FIG. 38.

The click plate 112 is strongly pressed by the spring 125 through the dog 119, to thereby prevent rotating the click plate 112. Further, the locking piece 117 projected on the inner surface of the first cylindrical body 12 is fitted to a plurality of the recessed groove 116 formed on the circumference surface of the click plate 112, and stands by the communicating the rotating force by the first cylindrical body 12. This state is illustrated in FIGS. 31 and 32.

Further, since moving the connecting plates 92*c*, 92*d* is prevented as described above, a plurality of the movable blocks 127 to 129 mounted at the predetermined position is stopped at the fixed position, and a plurality of the joint blocks 139 to 141 arranged behind the movable blocks 127 to 129 is mounted at the connecting plates 92*a*, 92*b* to be positioned at the fixed position.

The movable blocks 127 to 129 and the joint blocks 139 to 141 form the space 124 and the space 145, which is the approximately same as the space 124, and are separated, where the each joint block correspond to each movable block. Between each pairs of the movable blocks 127 to 129 and the joint blocks 139 to 141, the guide pin 133 is fitted to the guide hole 143, and the slide rod 135 is fitted to the through hole 144 and the collar 149.

Further, the tip portions 46*a*, 55*a*, 56*a* of the needle tubes 46, 55, 56 are closely opposed to the sealing plates 23 to 25 of the gas cylinders 20 to 22 mounted on the joint blocks 139 to 141.

On the other hand, on the second cylindrical body 13 side, the movable block 129 at the most front end is stopped at the fixed position, and a contacting terminal 160 mounted at the block 129 is stopped. Therefore, the contacting terminal 160 and the contacting terminal 159 are intercepted through the insulation film (it is not illustrated in the drawings), and a power source circuit of the LED 96 is opened to light the LED 96.

When a fire is extinguished using the fire extinguisher 6 in the above-state at the time of a fire occurring, the following operations are carried out, that is, holding the fire extinguisher 6 mounted at the fire extinguisher holder 1, pulling up a little, removing an opening edge portion of the through hole 6*b* from the locking claw 1*b*, and canceling engagements of those. By these operations, the fire extinguisher 6 can be easily removed.

Then, the following operations are also carried out, that is, holding the fire extinguisher 6 to move to a fire spot, and directing the second cylindrical body 13, which is on the fire extinguishing gas jetting side, toward the origin of the fire, holding the top end portion of the operating piece 106 while holding the first cylindrical body 12, pulling up the locking claw 106*b* in the arrow direction in FIG. 32 as a supporting point, and removing the locking claw 106*b* from the first cylindrical body 12.

By the above operations, the lock claw 18 of the operation piece 106 is removed from the space 124 between the clutch 113 and the click plate 112.

Further, the following operations are carried out, that is, rotating the first cylindrical body 12 in the axial direction, rotating simultaneously the locking piece 117 projected on the inner surface of the body 12, transporting the rotating force to the click plate 112 through the recessed groove 116 fitted with the locking piece 117, and rotating the click plate 112.

According to the rotation of the click plate 112, the dog hole 118 is positioned right in front of the dog 119, and the dog 119 is rapidly pushed backwardly by the elasticity of the strong spring 125 to be engaged with the dog hole 118.

Figure 40:
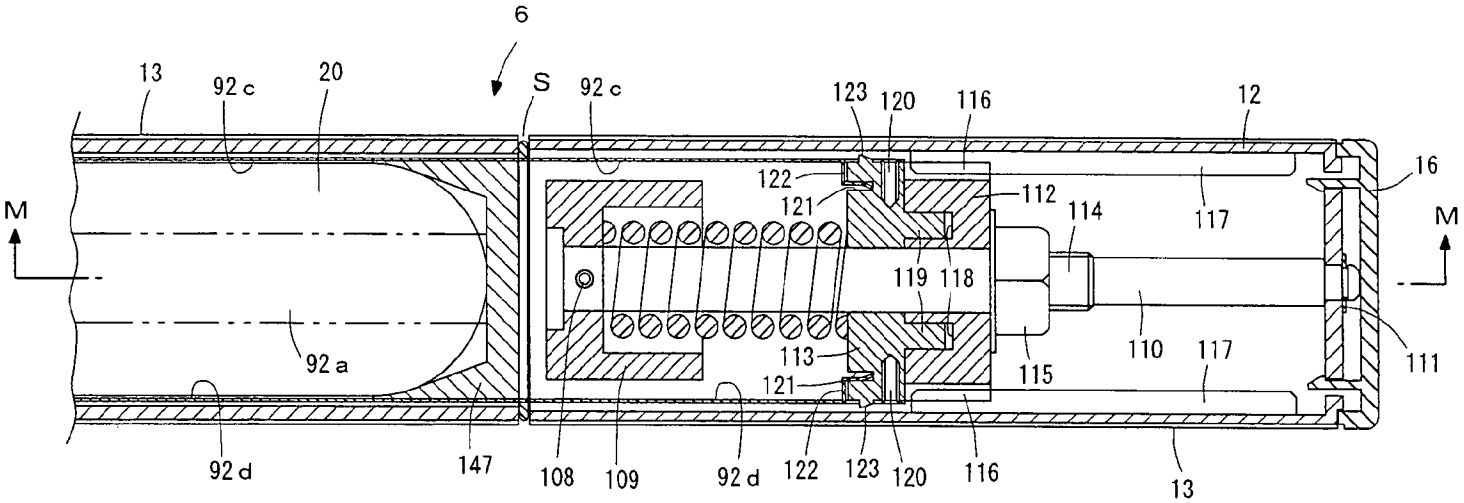
FIG. 40 is an enlarged cross-sectional view illustrating the main portions of FIG. 28 and the inside structure of the first cylindrical body after the seal breaking operation.
Figure 41:
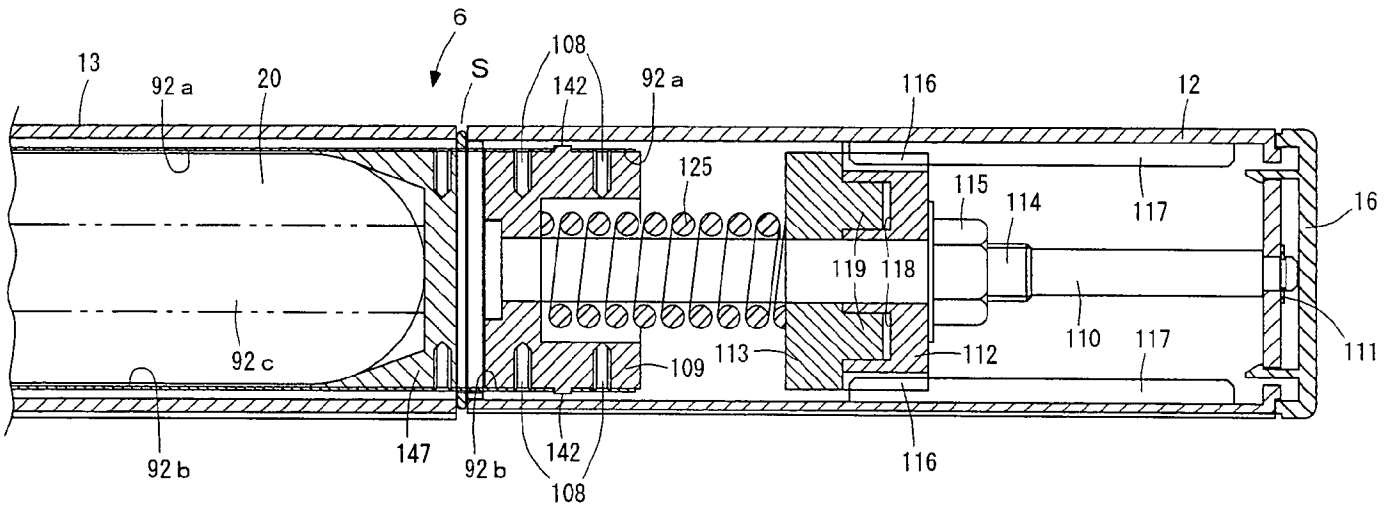
FIG. 41 is a cross-sectional view taken along the M-M line of FIG. 40.
Figure 42:
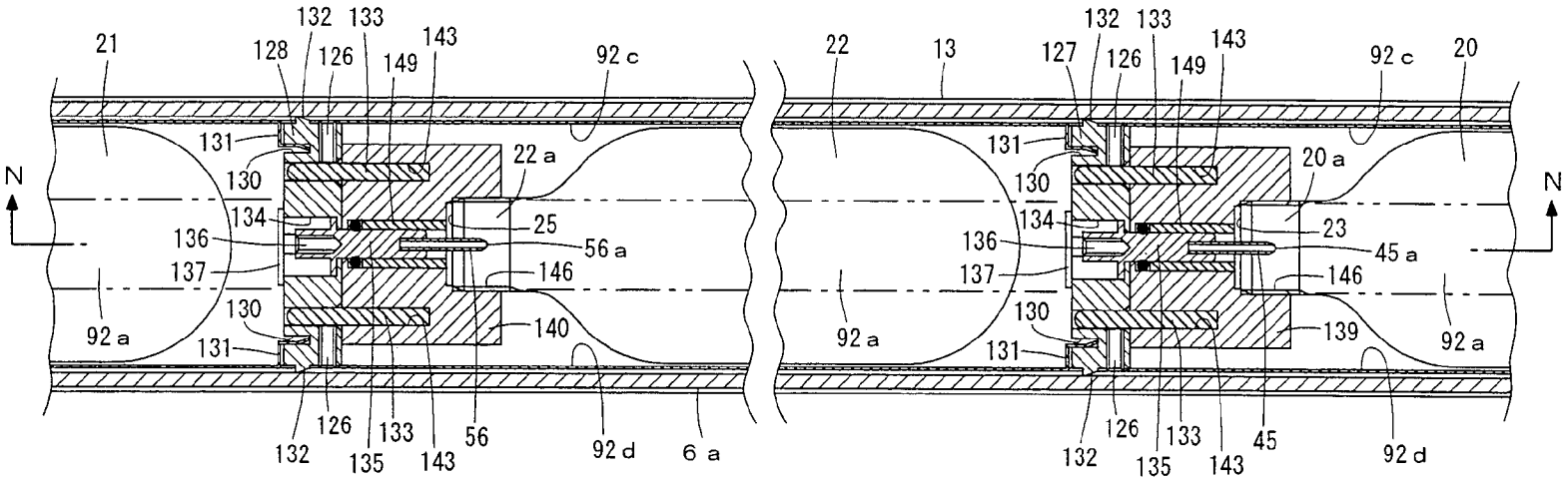
FIG. 42 is an enlarged cross-sectional view illustrating the main portions of FIG. 28 and the inside structure of the middle portion of the second cylindrical body after the seal breaking operation.
Figure 43:
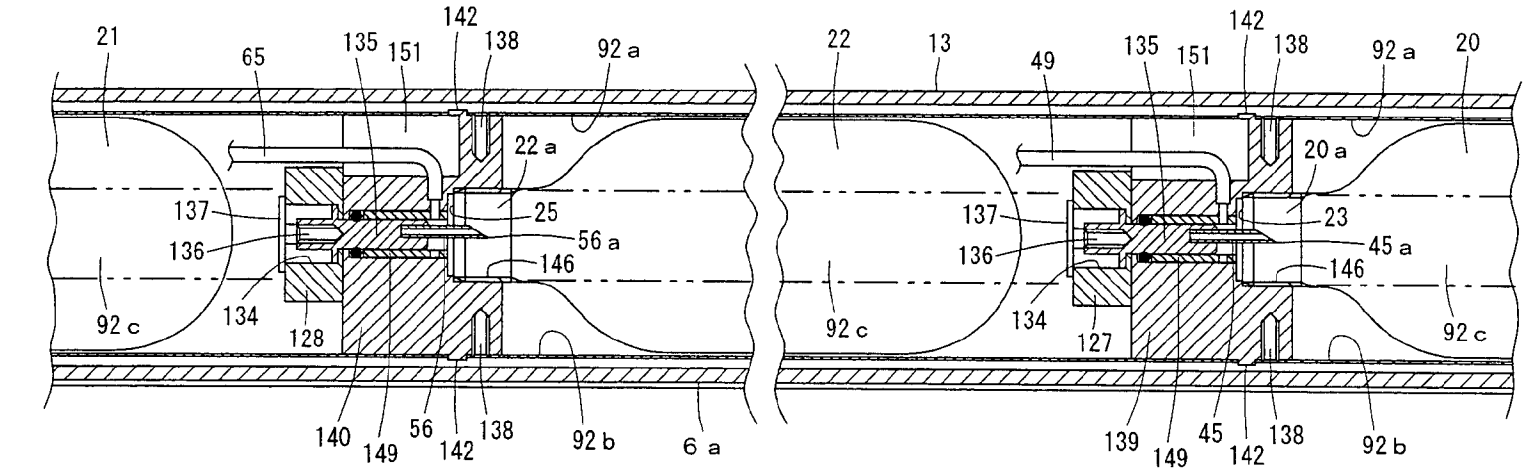
FIG. 43 is a cross-sectional view taken along the N-N line of FIG. 42.
Figure 44:
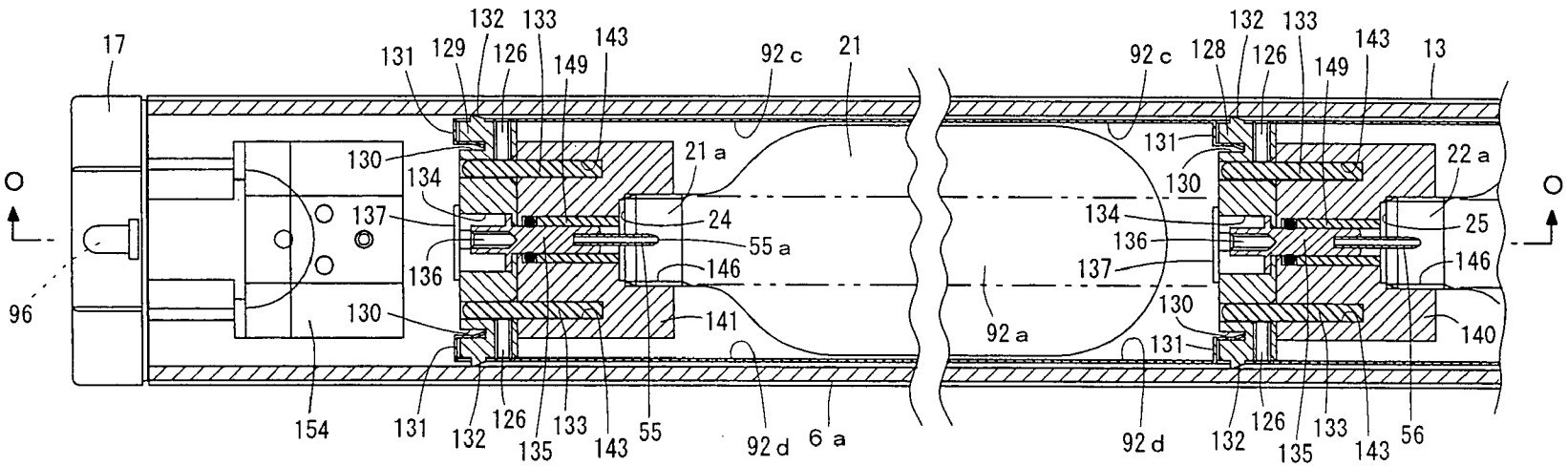
FIG. 44 is an enlarged cross-sectional view illustrating the main portions of FIG. 28 and the inside structure of the second cylindrical body after the seal breaking operation.
Figure 45:
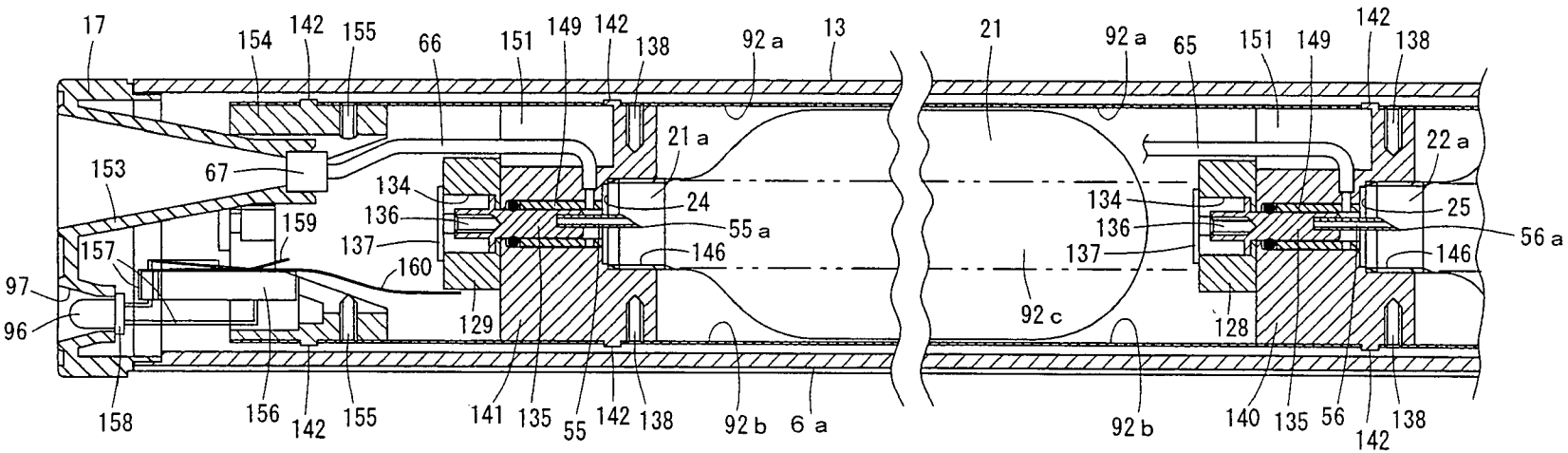
FIG. 45 is a cross-sectional view taken along the O-O line of FIG. 44.

This state is illustrated in FIGS. 40 and 41. The clutch 113 is moved in the distance of the space 124, and the connecting plates 92*c*, 92*d* mounted at the clutch 113 are simultaneously rotated.

Accordingly, the movable blocks 127 to 129 are pulled and moved by the connecting plates 92*c*, 92*d*, and moved rapidly in the upper and right direction in FIGS. 34, 35, 37 and 38, that is, closely moved on the joint blocks 139 to 141 sides. Then, tip portions 46*a*, 55*a*, 56*a* of the needle tubes 46, 55, 56 are vigorously pierced to the sealing plates 23 to 25 of the gas cylinders 20 to 22, to thereby simultaneously break the seals of the sealing plates 23 to 25.

After the seal breaking, the movable blocks 127 to 129 are moved in the distance of the space 145 and stopped when completely piercing.

In this embodiment, the movable blocks 127 to 129 are stopped while contacting with the joint blocks 139 to 141. This state is illustrated in FIGS. 42 to 45.

As a result of this, carbon dioxide filled in the gas cylinders 20 to 22 flow out from the needle tubes 46, 55, 56 to be moved to the guide hole 152. Then, carbon dioxide is moved in the gas guide tubes 49, 65, 66 from the guide hole 152 to be guided to the nozzle 67. Then, these carbon dioxide gases are joined and jetted from the jetting port. Then, carbon dioxide is jetted toward the origin of a fire from the gas jetting port 153.

In this case, a part of the jetted the carbon dioxide is adiabatically expanded to become the dry ice after jetting from the jetting port, and the dry-iced carbon dioxide is mixed with the gaseous carbon dioxide to be jetted to the origin of a fire. Therefore, the temperature around the origin of a fire is lowered, and feeding oxygen to around the origin of a fire is intercepted, so that the fire extinguishing operation can be efficiently carried out, and the fire can be extinguished quickly.

At this time, carbon dioxide jetted from the gas cylinders 20 to 22 is jetted in the gaseous state, flows out from the needle tubes 45, 55, 56 having comparatively large diameters to the small divided sliding holes 35, 37, 39, and flows out to the gas guide tubes 49, 65, 66. Accordingly, the adiabatically expansion is carried out gradually and gently, to thereby prevent dry-icing or solidifying carbon dioxide in the moving processes.

Therefore, after jetting from the nozzle 79, whole carbon dioxide is not dry-iced, and there are no problems that the around of the jet portion is solidified to thereby generate clogging. Accordingly, the stable fire extinguishing operation can be obtained.

On the other hand, when the movable block 129 at the most front end is moved simultaneously with the connecting plates 92*c*, 92*d* as described above, the contacting terminal 160 mounted at the block 129 is moved simultaneously, and the another end portion of the contacting terminal 160 is deviated from a non-conducting region of the insulation film (it is not illustrated in the drawings), and contacted with the contacting terminal 159.

Accordingly, the contacting terminals 159 and 160 are conducted to close the power source circuit of the LED 96, to thereby light the LED 96. Therefore, since the irradiation light of the LED 96 is radiated from the irradiation port 97 and the origin of a fire is lighted up, the fire extinguishing operation under night or a power failure can be carried out easily and safely. Further, since the cap 17 is lighted red, the light can be used as used as the emergency light.

In this way, as for the fire extinguishing operation by the present invention, the fire extinguisher 6 is held while directing the fire extinguishing gas jetting portion toward the origin of a fire. And the first cylindrical body 12 is rotated and operated after operating the operating piece 106. Therefore, it can be stopped the following conventional complex and complicated operation, that is, removing the safety plug, operating the handle to lower the perforating needle, breaking the seal of the sealing plate of the pressure gas cylinder, and directing the jetting nozzle toward the origin of a fire. Further, the fire extinguishing can be corresponded easily and quickly.

In addition, as for the fire extinguisher 6, the fire extinguishing operation is finished after jetting carbon dioxide from the gas cylinders 20 to 23. Then, moving the movable blocks 127 to 129 is kept by the spring 125 to thereby keep the lighting state of the LED 96, so that the fire extinguisher 6 can be used as the emergency light after finishing the fire extinguishing.

Figure 46:
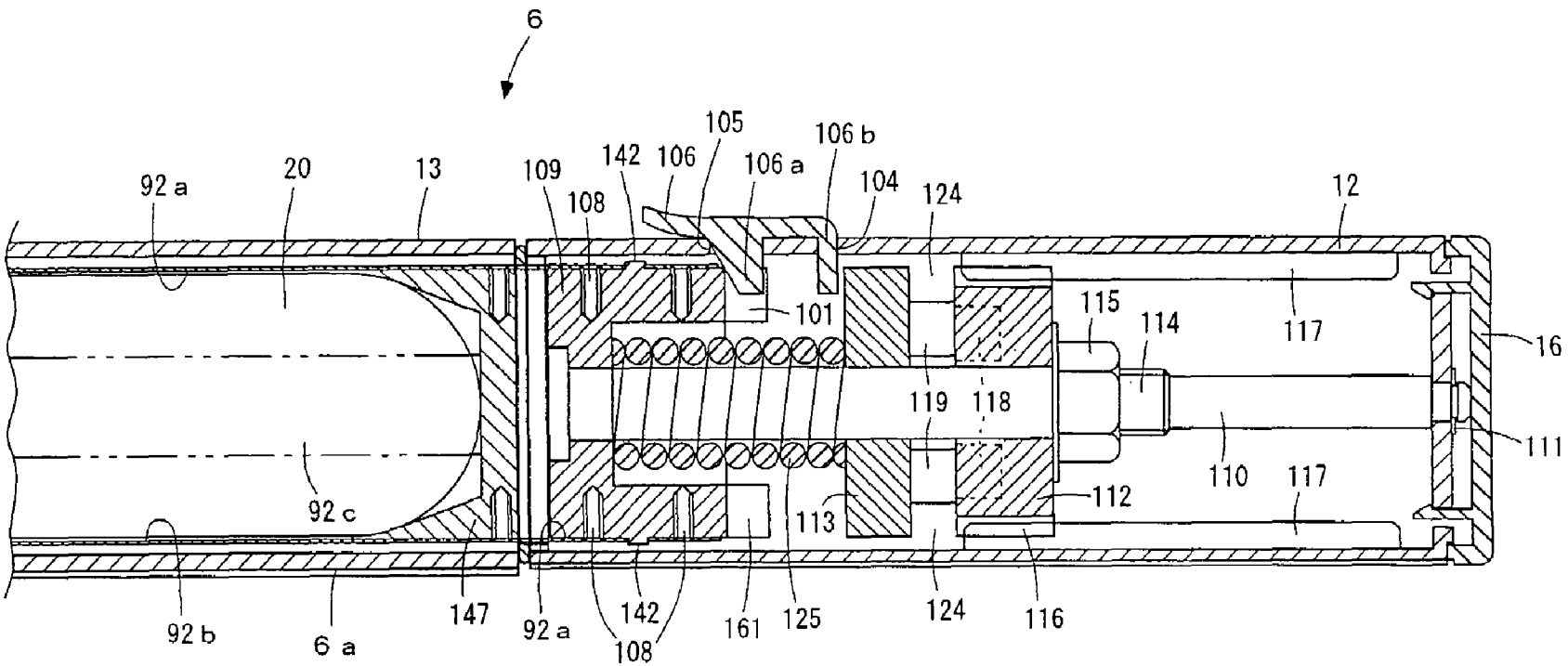
FIG. 46 is a cross-sectional view illustrating main portions of a sixth embodiment according to the present invention, and the inside structure of the first cylindrical body before the seal breaking operation.

FIG. 46 illustrates a sixth embodiment of the present invention, which is an applying embodiment of the above-described embodiment. An engaging groove 161 having an approximately U shaped plane is formed at the rear end portion of the spring support 109, the notch grooves 104, 105 are formed on the first cylindrical body 12 in the upper direction of the groove 161, and the lock claw 106*a* is engageably arranged at the notch groove 105. Thereby, the first cylindrical body 12 can be prevented to be rotated.

Therefore, when the fire extinguisher 6 is packed or conveyed, rotating the first cylindrical body 12 can be accurately prevented, moving the clutch plate 113 is prevented beforehand. Further, the seal breakings of the gas cylinders 20 to 22 can be strengthened, in order to ensure safe use of the fire extinguisher.

Further, when the operation piece 106 is arranged at the end portion of the first cylindrical body 12 like this embodiment, the holding space of the first cylindrical body 12 can be widely kept, so that the fire extinguisher 6 can be operated easily and used safely.

In addition, as the applying embodiment of the fifth and sixth embodiments, the following embodiment can be also used, that is, an embodiment comprising the steps of housing a powder container filled with the powder fire extinguishing chemical behind the nozzle 67; connecting the discharging sides of the gas guide tubes 49, 65, 66 with the powder container; communicating the powder container with the nozzle 79; guiding carbon dioxide jetted from the gas cylinders 20 to 22 to the powder container; pushing out the powder fire extinguishing chemical in the container to the nozzle 67; and jetting the chemical from the nozzle 67.

Further, in the fifth and sixth embodiments, a plurality of the gas cylinders 20 to 22 is charged in the fire extinguisher 6. However, a single gas cylinder can be charged, and it can be also used with removing gas cylinders arranged in the middle among a plurality of the gas cylinders 20 to 22.

According to the seal breaking apparatus of the gas cylinder of the present invention, a single or a plurality of the gas cylinder is compactly incorporated, to thereby reduce in size and weight and increase the appearance. Further, the seals of the gas cylinders can be easily and safely broken at one time, large amounts of gas can be used quickly and safely, solidifying the dry ice and closing the flowing passage after breaking the seals can be prevented, and the stable gas jetting state can be obtained. Accordingly, this seal breaking apparatus of the gas cylinder is suitable, for example, to the carbon dioxide fire extinguisher for household, office or vehicle using the cartridge type gas cylinder.

What is claimed is:

1. A fire extinguisher, comprising a plurality of gas cylinders, each filled with a gas and having a mouth portion;

a sealing plate for each gas cylinder sealing the mouth portion of the gas cylinder;

two cylindrical bodies, each housing at least one of the gas cylinders, the gas cylinders housed within each cylindrical body being oriented in the same axial direction;

joint blocks provided in the cylindrical bodies, each joint block holding the mouth portion of one or more of the gas cylinders, the mouth portion of each gas cylinder being held by only one joint block, and each joint block having a cavity;

guide cylinders provided within the cavity of the joint block, one guide cylinder for each gas cylinder that the joint block is holding, each guide cylinder having a sliding hole oriented toward the sealing plate on the mouth portion of the corresponding gas cylinder;

needle tubes, one needle tube slidably fitted into each one of the sliding holes, each needle tube capable of breaking the sealing plate of the corresponding gas cylinder, the needle tube having a through hole configured to guide the gas as it is discharged from the gas cylinder when the needle tube breaks the sealing plate; and needle tube holders slidably fitted into the sliding holes holding the needle tubes in the sliding holes, wherein for each gas cylinder at least one of the gas cylinder, the corresponding guide cylinder and the corresponding needle tube holder is provided to be movable in such a manner as to concurrently bring together the needle tube and the sealing plate for all the gas cylinders to break the sealing plate with the needle tube holder.

2. The fire extinguisher according to claim 1, wherein the mouth portions of a plurality of the gas cylinders housed in the cylindrical bodies are arranged in the same direction.

3. The fire extinguisher according to claim 1, wherein the mouth portions of a plurality of the gas cylinders housed in the cylindrical bodies are arranged in opposing directions.

4. The fire extinguisher according to claim 1, further comprising a plurality of gas guiding tubes connected in series forming a conduit configured to guide the gas as it is discharged from the gas cylinders to a termination end of the conduit; and a nozzle connected to the termination end of the conduit.

5. The fire extinguisher according to claim 1, further comprising gas guiding tubes, one gas guiding tube for each of the gas cylinders, wherein each of the gas guiding tubes forms a separate conduit configured to guide the gas as it is discharged from one of the gas cylinders to a termination end; and nozzles, one connected to the termination end of each conduit.

6. The fire extinguisher according to claim 4 or 5, wherein each nozzle is provided at a top end portion of one of the cylindrical bodies.

7. The fire extinguisher according to claim 1, further comprising a light provided at an end portion of one of the cylindrical bodies, the light configured to turn on when the seal plates are broken.

8. The fire extinguisher according to claim 4 or 5, further comprising a container housing a powder fire extinguishing chemical that is provided between the termination ends of each conduit and each nozzle, each nozzle provided at an end portion of one of the cylindrical bodies.

9. The fire extinguisher according to claim 1, further comprising a pair of connecting plates housed in one of the cylindrical bodies, wherein all the gas cylinders, joint blocks and needle tube holders within the one cylindrical body are arranged between the connecting plates.

10. The fire extinguisher according to claim 1, wherein each needle tube has a tip portion oriented towards a line running through the center of the sealing plate of the corresponding gas cylinder.

11. The fire extinguisher according to claim 1, wherein the gas in the gas cylinders is high pressure carbon dioxide.

12. A fire extinguisher, comprising a plurality of gas cylinders, each filled with a gas and having a mouth portion;

a sealing plate for each gas cylinder sealing the mouth portion of the gas cylinder;

two cylindrical bodies, rotatably connected together along their axes at a connection portion, each of the gas cylinders being housed in one of the two cylindrical bodies, the gas cylinders housed within each cylindrical body being oriented in the same axial direction;

joint blocks, one or more provided in each of the cylindrical bodies, each joint block holding the mouth portion of one or more of the gas cylinders, the mouth portion of each gas cylinder being held by only one joint block, and each joint block having a cavity;

guide cylinders provided within the cavity of the joint block, one guide cylinder for each gas cylinder that the joint block is holding, each guide cylinder having a sliding hole oriented toward the sealing plate on the mouth portion of the corresponding gas cylinder;

needle tubes, one needle tube slidably fitted into each one of the sliding holes, each needle tube capable of breaking the sealing plate of the corresponding gas cylinder, the needle tube having a through hole configured to guide the gas as it is discharged from the gas cylinder when the needle tube breaks the sealing plate; and needle tube holders slidably fitted into the sliding holes holding the needle tubes in the sliding holes, wherein for each gas cylinder at least one of the gas cylinder, the corresponding guide cylinder and the corresponding needle tube holder is provided to be movable in such a manner as to concurrently bring together the needle tube and the sealing plate for all the gas cylinders to break the sealing plate with the needle tube holder.

13. The fire extinguisher according to claim 12, further comprising cams at the connection portion of the two cylindrical bodies, wherein the cams translate the relative rotational movement of the cylindrical bodies with respect to each other into linear movement of one or more of the gas cylinders and/or one or more of the needle tube holders along the axis of the cylindrical body in which the gas cylinder or the needle tube holder is housed.

14. The fire extinguisher according to claim 13, wherein one of the two cylindrical bodies houses two gas cylinders whose mouth portions are arranged to face each other, and arranged between the mouth portions of the cylinders facing each other is one of the needle tube holders slidably mounted into two guide cylinders having needle tubes in the sliding holes.

15. The fire extinguisher according to claim 12, wherein the two cylindrical bodies are a first cylindrical body and a second cylindrical body, the fire extinguisher further comprising a movable body housed in the first cylindrical body, wherein the movable body can be displaced in the axial direction of the first cylindrical body after the first cylindrical body is rotated to a predetermined angle, the joint blocks and the needle tube holders are provided in the second cylindrical body, the gas cylinders are housed in the same axial direction, and each needle tube holder is connected to the movable body to allow for concurrent displacement of the needle tube holders toward their respective joint blocks with the displacement of the movable body.

16. The fire extinguisher according to claim 15, further comprising a pair of connecting plates that are movably provided and extend from the first cylindrical body to the second cylindrical body, wherein the movable body and the needle tube holders are provided between the connecting plates.

17. The fire extinguisher according to claim 16, further comprising a second pair of connecting plates provided at a fixed position in the second cylindrical body, the joint blocks fixedly connected to the second pair of connecting plates.

18. The fire extinguisher according to claim 15, further comprising an operation piece provided on a circumference surface of the first cylindrical body, the operation piece having a lock claw provided at a location along the axis of the first cylindrical body where the movable body is movably energized in the axial direction, the lock claw restraining the axial movement of the moveable body, and the lock claw capable of disengaging the restraint on the movable body.

19. The fire extinguisher according to claim 18, further comprising a fixed member fixedly positioned at an end portion side of the first cylindrical body, the fixed member having an engaging groove, wherein the lock claw of the operation piece is disengageably provided at the engaging groove.

20. The fire extinguisher according to claim 12, further comprising a joining ring releasably provided at the connecting portion, wherein one of the cylindrical bodies can be bent through peeling the joining ring.

21. The fire extinguisher according to claim 18 wherein the movable body is a clutch plate.

* * * * *